US007881634B2

(12) United States Patent
Zensai

(10) Patent No.: US 7,881,634 B2
(45) Date of Patent: Feb. 1, 2011

(54) IMAGE FORMING APPARATUS IN WHICH TRANSFER MEMBER IS MOVABLE TOWARD AND APART FROM IMAGE BEARING MEMBER

(75) Inventor: Shoichi Zensai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 709 days.

(21) Appl. No.: 11/842,642

(22) Filed: Aug. 21, 2007

(65) Prior Publication Data

US 2008/0050148 A1 Feb. 28, 2008

(30) Foreign Application Priority Data

Aug. 23, 2006 (JP) ..... 2006-226495

(51) Int. Cl.

| | |
|---|---|
| ***G03G 15/08*** | (2006.01) |
| ***G03G 15/00*** | (2006.01) |
| ***G03G 15/16*** | (2006.01) |
| ***G03G 21/16*** | (2006.01) |
| ***G03G 15/01*** | (2006.01) |

(52) U.S. Cl. ..... 399/121; 399/13; 399/66; 399/110; 399/111; 399/299

(58) Field of Classification Search ..... 399/13, 399/121, 299

See application file for complete search history.

(56) References Cited

U.S. PATENT DOCUMENTS

| | | | | |
|---|---|---|---|---|
| 6,564,021 | B1 * | 5/2003 | Nakai et al. | 399/49 |
| 6,701,101 | B2 * | 3/2004 | Ahn | 399/66 |
| 6,795,671 | B2 | 9/2004 | Matsuoka | 399/233 |
| 7,054,578 | B2 * | 5/2006 | Jung et al. | 399/110 |
| 7,130,552 | B2 * | 10/2006 | Nishida et al. | 399/66 |
| 7,187,877 | B2 * | 3/2007 | Yamaguchi | 399/37 |
| 7,218,868 | B2 * | 5/2007 | Ahn et al. | 399/13 |
| 2005/0158074 | A1 * | 7/2005 | Murakami et al. | 399/121 |
| 2006/0140668 | A1 * | 6/2006 | Sato et al. | 399/110 |
| 2007/0036585 | A1 * | 2/2007 | Ochi | 399/121 |

FOREIGN PATENT DOCUMENTS

| | | | |
|---|---|---|---|
| JP | 06324533 | A * | 11/1994 |
| JP | 8-314290 | | 11/1996 |
| JP | 2001-083758 | | 3/2001 |
| JP | 2003-208024 | | 7/2003 |
| JP | 2004-118019 | | 4/2004 |

* cited by examiner

*Primary Examiner*—David M Gray
*Assistant Examiner*—Francis Gray
(74) *Attorney, Agent, or Firm*—Fitzpatrick, Cella, Harper & Scinto

(57) ABSTRACT

In a constitution for detecting a position of a transfer member on the basis of a detection result of a current passing between the transfer member and an image bearing member, the positional detection is performed after a contacting and separating operation of the transfer member is carried out. By the contacting and separating operation of the transfer member, the image bearing member located out of a normal position is pressed to the normal position by the transfer member. After the image bearing member is pressed to the normal position, a position of the transfer member is detected.

6 Claims, 26 Drawing Sheets

(a)

(b)

IMAGE FORMING APPARATUS IN WHICH TRANSFER MEMBER IS MOVABLE TOWARD AND APART FROM IMAGE BEARING MEMBER

FIELD OF THE INVENTION AND RELATED ART

The present invention relates to an image forming apparatus including a transfer member located opposite to an image bearing member and capable of switching between a state in which the image bearing member and the transfer member form a nip therebetween and a station in which the image bearing member and the transfer member do not form the nip.

An image forming apparatus in which a toner image formed on an image bearing member such as a photosensitive drum or an intermediary transfer member is transferred by a transfer member such as a transfer roller forming a transfer nip with the image bearing member has been known. In such an image forming apparatus, transfer member can be moved relative to the image bearing member so as to form the transfer nip with the image bearing member or be spaced apart from the image bearing member. When the transfer member forms the transfer nip with the image bearing member, the toner image on the image bearing member can be transferred but when the transfer member is spaced apart from the image bearing member, the toner image on the image bearing member cannot be transferred. For this reason, depending on a position of the transfer member, the image forming apparatus performs different operations. Japanese Laid Open Patent Application (JP A) 2001 083758 has disclosed an image forming apparatus in which the position of the transfer member is recognized by the image forming apparatus and the operation of the image forming apparatus is performed on the basis of a recognition result. In this image forming apparatus, a relative position between the transfer member and the image bearing member is detected by detecting a current passing through the transfer member. The thus detected relative position of the transfer member with respect to the image bearing member is recognized as the position of the transfer member. More specifically, a current passing when a voltage is applied to the transfer member is detected. When the detected current is large, a path of a current flowing from the transfer member to a photosensitive drum as the image bearing member is present, so that formation of the transfer nip between the photosensitive drum and the transfer member is recognized. However, in the case where the image bearing member is shifted toward the transfer member side, the image forming apparatus disclosed in JP A 2001 083758 erroneously recognizes that the transfer member is located on a side close to the image bearing member even when the transfer member is located at a position originally apart from the image bearing member. This is because the image forming apparatus recognizes the position of the transfer member on the basis of a relative position of the transfer member with respect to the image bearing member. In the case where the position of the transfer member is erroneously recognized, a subsequent sequence of the image forming apparatus can be executed on the basis of the erroneous recognition.

SUMMARY OF THE INVENTION

A principal object of the present invention is to prevent the above-described erroneous recognition leading to execution of an erroneous sequence of an image forming apparatus.

Another object of the present invention is to provide an image forming apparatus capable of preventing erroneous recognition of a position of a transfer member to prevent execution of an erroneous sequence.

According to an aspect of the present invention, there is provided an image forming apparatus comprising:

a unit comprising an image bearing member for bearing a toner image, the unit being detachably mountable to a main assembly of the image forming apparatus;

a transfer member for transferring the toner image from the image bearing member;

a moving mechanism for moving the transfer member toward and away from the image bearing member;

a recognizing portion for recognizing a position of the transfer member, wherein the transfer member is moved close to the image bearing member to press the image bearing member, wherein an angle formed between a direction in which the unit is inserted into the main assembly of the image forming apparatus and a direction in which the transfer member is moved toward the image bearing member is an acute angle, and wherein the recognizing portion recognizes the position of the transfer member after the transfer member is moved toward and away from the image bearing member.

According to another aspect of the present invention, there is provided an image forming apparatus comprising:

a unit comprising an image bearing member for bearing a toner image, the unit being detachably mountable to a main assembly of the image forming apparatus;

a transfer member for transferring the toner image from the image bearing member;

a moving mechanism for moving the transfer member toward and away from the image bearing member;

a power source for applying a voltage to the transfer member, a sensor for detecting a current passing through the transfer member or a voltage applied to the transfer member; and a recognizing portion for recognizing a position of the transfer member on the basis of a detection result of the sensor, wherein the recognizing portion recognizes the position of the transfer member after the transfer member is moved toward and away from the image bearing member.

According to a further aspect of the present invention, there is provided an image forming apparatus comprising:

a unit comprising an image bearing member for bearing a toner image, the unit being detachably mountable to a main assembly of the image forming apparatus;

a transfer member for transferring the toner image from the image bearing member;

a moving mechanism for moving the transfer member toward and away from the image bearing member;

a belt located between the transfer member and the image bearing member; and a recognizing portion for recognizing that the transfer member contacts the belt, wherein the recognizing portion recognizes the position of the transfer member after the transfer member is moved toward and away from the image bearing member.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described more specifically with reference to the drawings. In the following, dimensions, materials, shapes, and relative arrangements of constituent elements may appropriately be changed depending on constitutions and various conditions for an image forming apparatus according to the present invention. Accordingly, it should be understood that the present invention is not limited to those specifically described in the following unless otherwise noted specifically.

First Embodiment

The first embodiment of the image forming apparatus according to the present invention will be described in detail with reference to the drawings.

[General Structure of Image Forming Apparatus]

Figure 1:
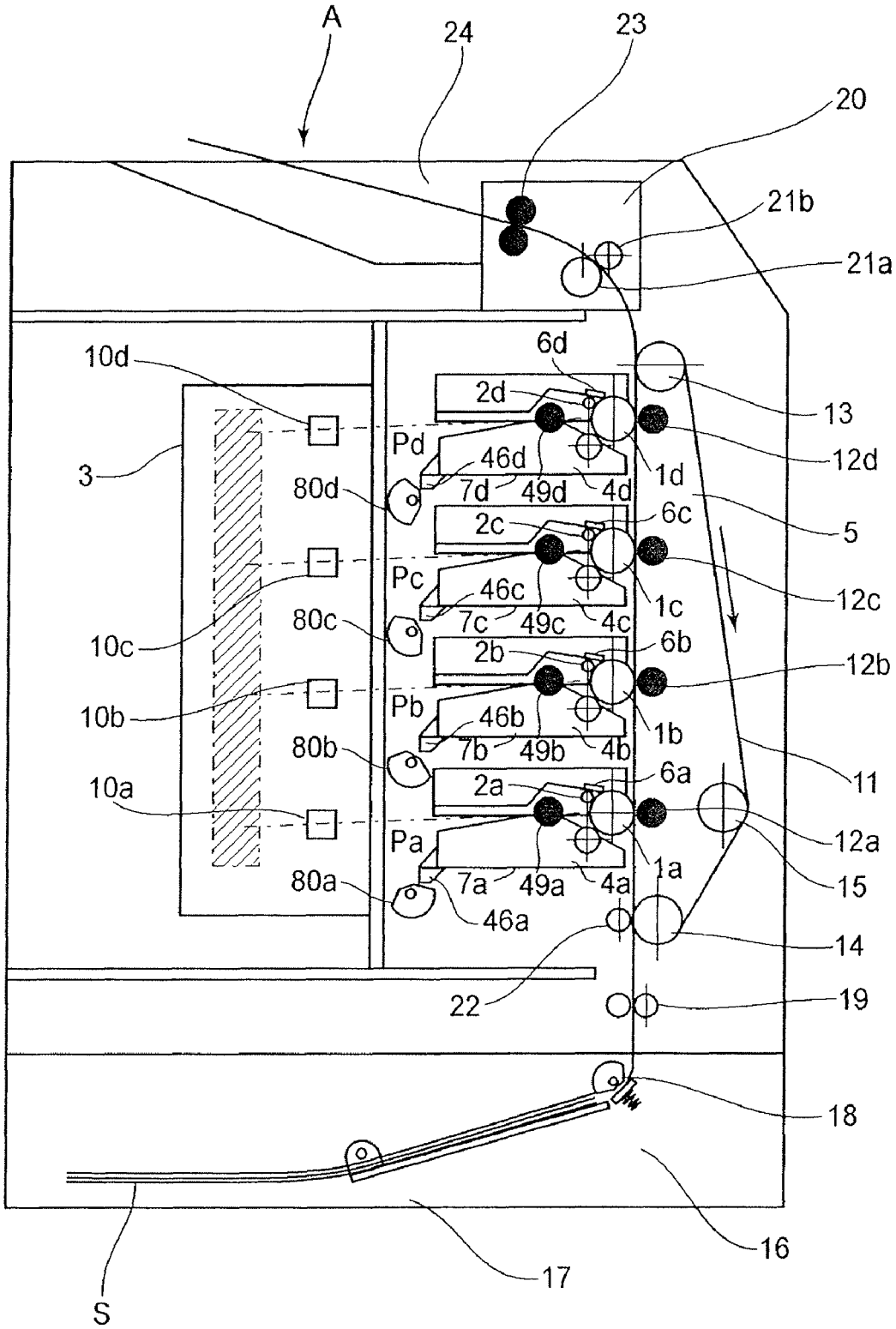
FIG. 1 is a sectional view of an image forming apparatus according to a first embodiment.

First, the general structure of the image forming apparatus will be explained with reference to FIG. 1. FIG. 1 is a sectional view showing the general structure of the image forming apparatus of this embodiment. Referring to FIG. 1, an image forming apparatus A is capable of forming color images. More specifically, the image forming apparatus A is capable of forming a full-color image on a recording material such as a recording sheet or an OHP sheet according to electrophotography depending on an image information signal sent from an apparatus such as a personal computer communicatable with a main assembly of the image forming apparatus A through wire or wireless communication.

The image forming apparatus A shown in FIG. 1 includes four photosensitive drums 1 (1*a*, 1*b*, 1*c*, 1*d*) disposed in parallel with each other in a substantial vertical direction. These photosensitive drums 1 are rotationally driven in a counterclockwise direction in FIG. 1 by a driving means (described later) shown in FIG. 12. Around the photosensitive drums 1, charging apparatuses 2 (2*a*, 2*b*, 2*c*, 2*d*), a scanner unit 3, developing apparatuses 4 (4*a*, 4*b*, 4*c*, 4*d*), belt unit 5, cleaning apparatuses 6 (6*a*, 6*b*, 6*c*, 6*d*), and the like are disposed substantially in this order with respect to a rotational direction of the photosensitive drums 1. The charging apparatuses 2 electrically charge the photosensitive drums 1 uniformly. The scanner unit 3 irradiates each of the photosensitive drums 1 with a laser beam to form an electrostatic latent image on the photosensitive drums 1. Each of the developing apparatuses 4 attaches toner constituting a developer to the electrostatic latent image to develop the electrostatic latent image as a toner image. The belt unit 5 conveys a recording material S thereon to a position opposite to an associated photosensitive drum 1. The cleaning apparatuses 6 and the like remove transfer residual toner remaining on the photosensitive drums 1 after the toner image is transferred onto the recording material S.

Figure 2:
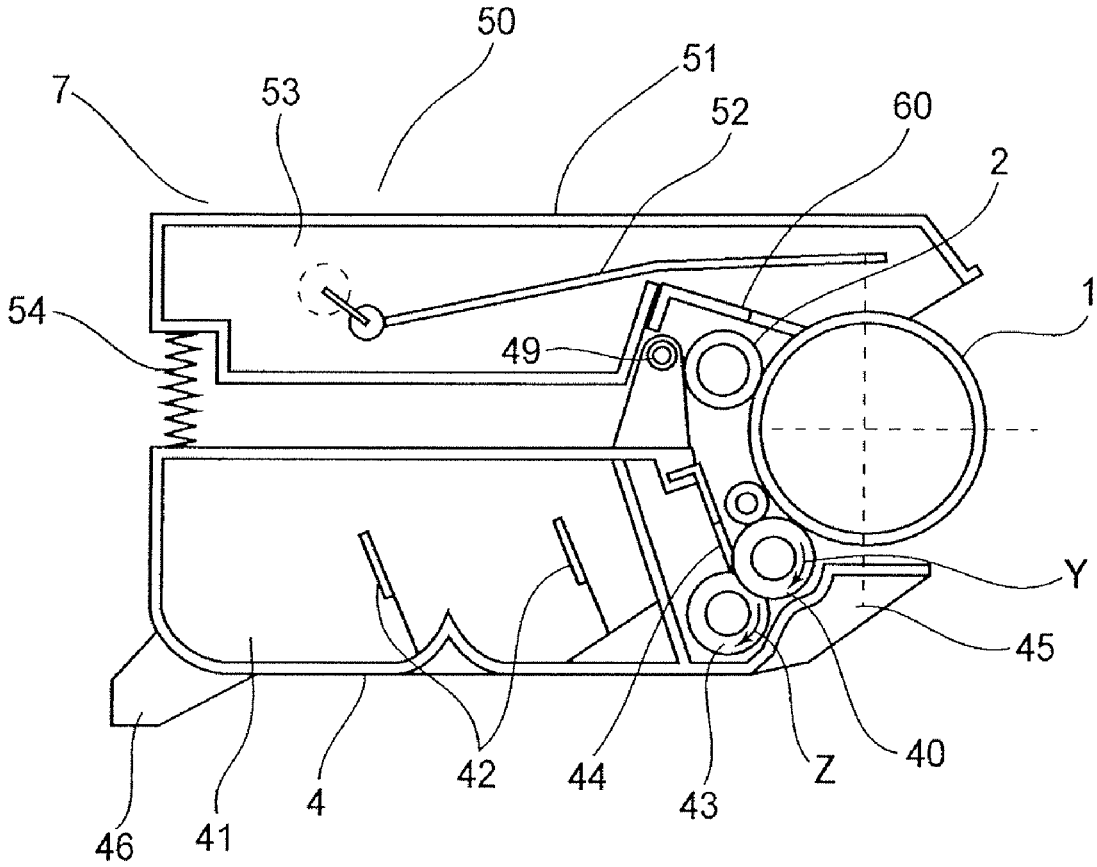
FIG. 2 is a sectional view of a process cartridge.

In this embodiment, each of four image forming portions P (Pa, Pb, Pc, Pd) is constituted by the photosensitive drum 1, the charging apparatus 2, the scanner unit 3, the developing apparatus (unit) 4, the cleaning apparatus 6, and the like. By these image forming portions P, toner images of different colors (yellow, cyan, magenta, black) are formed. The photosensitive drums 1, the charging apparatuses 2, the developing units 4, and the cleaning apparatuses 6 constitute process cartridges 7 (7*a*, 7*b*, 7*c*, 7*d*) each of which is configured and positioned to be detachably mountable to the image forming apparatus A as a single unit. FIG. 2 is a sectional view of the process cartridge 7. In the following description, a front side of the image forming apparatus A corresponds to a side from which the process cartridge 7 is inserted into a main assembly of the image forming apparatus A, i.e., a right side in FIG. 1. Further, right and left sides of the image forming apparatus A are those as seen from the front side of the image forming apparatus A. More specifically, in FIG. 1, a front side of the drawing is taken as a left side of the image forming apparatus A are a back side of the drawing is taken as a right side of the image forming apparatus A.

The photosensitive drum 1 is constituted by applying a layer of an organic photoconductor (OPC) onto an outer peripheral surface of an aluminum cylinder having a diameter of 25 mm. The photosensitive drum 1 is rotatably supported at both end portions thereof by a supporting member. Through one end portion of the photosensitive drum 1, a driving force from a driving motor (not shown) is transmitted to the photosensitive drum 1, so that the photosensitive drum 1 is rotated in a counterclockwise direction in FIG. 1.

The charging apparatus 2 includes an electroconductive roller formed in a roller shape. The surface of the photosensitive drum 1 is electrically charged uniformly by bring this roller into contact with the surface of the photosensitive drum 1 and applying a charging bias voltage to this roller from a power source (not shown).

Figure 4:
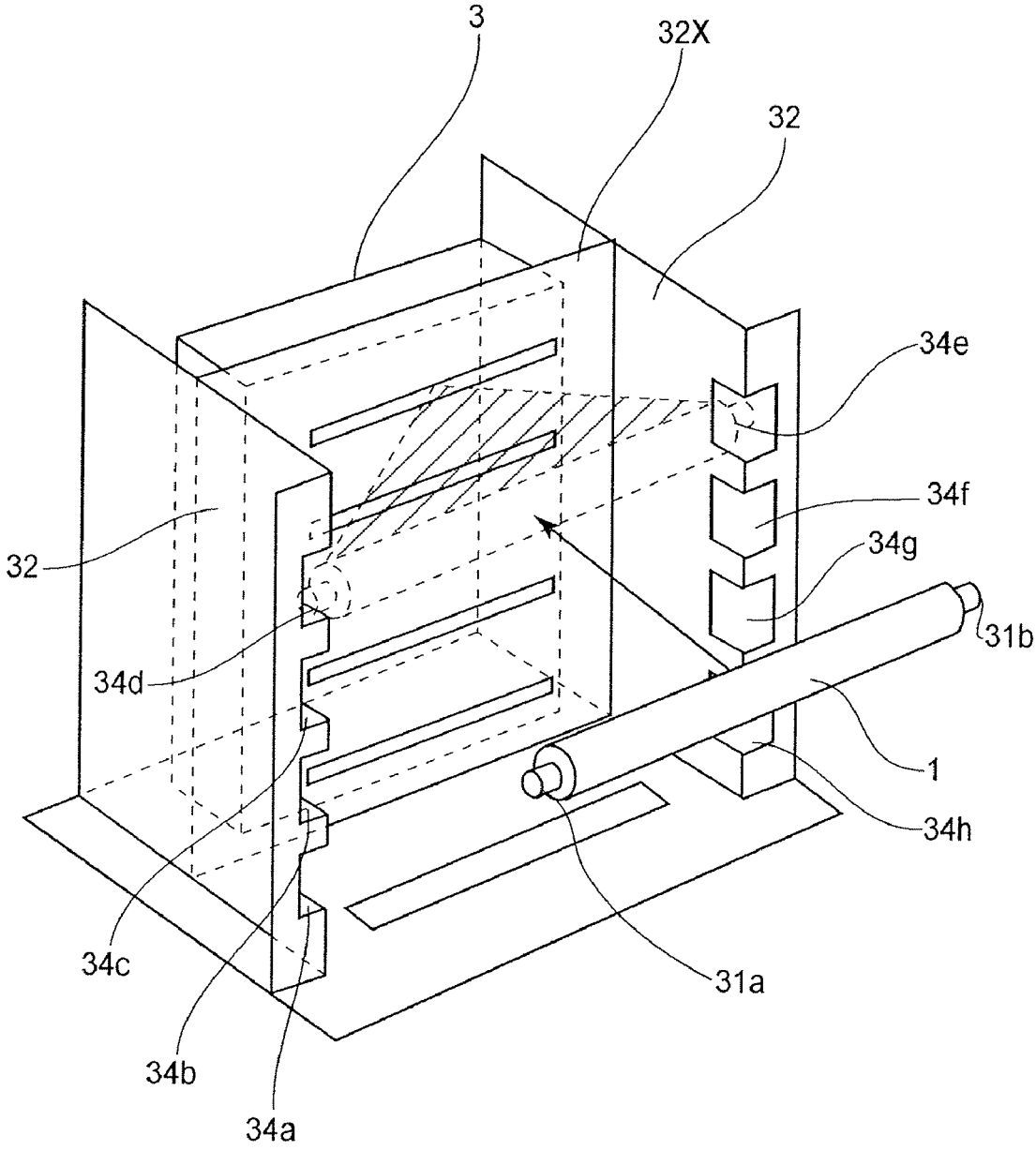
FIG. 4 is a perspective view showing an inner side plate of the image forming apparatus of the first embodiment and its neighborhood.

In the scanner unit 3, one photosensitive drum 1 is irradiated with light, corresponding to an image signal, which is emitted from one laser diode (not shown) and reflected by a polygon mirror (not shown). The charged surface of the photosensitive drum 1 is exposed to the light reflected by the polygon mirror through an imaging lens 10 (10*a*, 10*b*, 10*c*, 10*d*) to form thereon an electrostatic latent image. The scanner unit 3 is formed in a length smaller than a length between left and right side plates 32 with respect to a longitudinal direction as shown in FIG. 4 and is attached to an intermediary frame 32X vertically positioned between the left and right side plates 32.

The developing unit 4 is constituted by toner containers 41 (41*a*, 41*b*, 41*c*, 41*d*) containing yellow toner, magenta toner, cyan toner, and black toner, respectively. The developing unit 4 supplies toner contained in the toner container 41 to a toner supply roller 43 by a conveying mechanism 42. Further, toner is applied onto an outer peripheral surface of the developing roller 40 rotating in a clockwise direction by a developing blade 44 pressed against the outer peripheral surfaces of the toner supply roller 43 and the developing roller 40 which rotate in the clockwise direction as shown in FIG. 2. The toner applied to the outer peripheral surface of the developing roller 40 is electrically charged. By applying a developing bias to the developing roller 40 opposing the photosensitive drum 1 on which the electrostatic latent image is formed, development with the toner is performed on the photosensitive drum 1 depending on the electrostatic latent image.

The belt unit 5 includes an electrostatic transfer belt 11 as a belt member. The transfer belt 11 opposes all the photosensitive drums 1*a*, 1*b*, 1*c* and 1*d* and moves among positions contactable with the photosensitive drums 1*a*, 1*b*, 1*c* and 1*d*. The transfer belt 11 is an about 110 μm-thick film-like member having a volume resistivity of $10^{11}$-$10^{14}$ Ω·cm. The transfer belt 11, supported by three rollers, is moved upward at a left-side outer peripheral surface thereof while electrostatically absorbing a recording material S at the surface. As a result, the recording material S is conveyed to a transfer position by the transfer belt 11 and the transfer position, a toner image is transferred from the photosensitive drum 1 onto the recording material S.

Four transfer rollers 12 (12*a*, 12*b*, 12*c*, 12*d*) are disposed at positions where the transfer rollers 12 contact an inner surface of the transfer belt 11 and oppose the four photosensitive drums 1 (1*a*, 1*b*, 1*c*, 1*d*). A voltage of a positive polarity opposite to a normal charge polarity of the toner is applied to the transfer rollers 12, so that the toner images on the photosensitive drums are transferred onto the recording material S by electric fields created between the transfer rollers 12 and the photosensitive drums 1.

In this embodiment, the transfer belt 11 has a peripheral length of about 560 mm and a thickness of 110 μm and is supported by the three rollers including a drive roller 13, a follower roller 14, and a tension roller 15. The transfer belt 11 is rotated in a direction indicated by an arrow in FIG. 1 by the drive roller 13, so that the transfer belt 11 is circulated and moved. The toner image is transferred onto the recording material S during the conveyance of the recording material S from the follower roller 14 to the drive roller 13. Incidentally, due to jamming or the like, the toner can be directly deposited on the transfer belt 11. When the toner on the transfer belt 11 is removed, the toner on the transfer belt 11 is transferred onto the photosensitive drum 1 by more quickly moving the transfer belt 11 than the photosensitive drum 1 and, at the same time, applying to the transfer rollers a voltage of a polarity different from that of the voltage applied during the toner. As a result, it is possible to remove the toner deposited on the transfer belt 11. The toner transferred onto the photosensitive drum 1 is removed by cleaning into the process cartridge 7.

A sheet feeding portion 16 feeds the recording material S to the transfer belt 11. The recording material S is accommodated in a sheet feeding cassette 17. When the recording material S in the sheet feeding cassette 17 is fed one by one by a sheet feeding roller 18, a leading end of the fed recording material S once abuts against a registration roller pair 19. The recording material S abutting against the registration roller pair 19 is conveyed again, after a loop is formed, at timing when the recording material S can overlap with the toner image formed on the photosensitive drum 1. The recording material S is nipped between an electrostatic adsorption roller 22 and the transfer belt 11. When a voltage is applied between the electrostatic adsorption roller 22 and the transfer belt 11, electric charges are induced in the recording material S as a dielectric member and in a dielectric layer of the transfer belt 11, so that the recording material S is electrostatically adsorbed by the outer peripheral surface of the transfer belt 11. As a result, the recording material S can be conveyed to an extreme downstream transfer portion by the transfer belt 11.

Onto the recording material S, the toner images on the photosensitive drums 1 are successively transferred in a superposition manner by the electric fields created between the photosensitive drums 1 and the transfer rollers 12. The recording material S onto which four color toner images are transferred is separated from the transfer belt 11 by curvature at an opposing position of the drive roller 13 and thereafter is conveyed to a fixing portion 20. The recording material S is, after being subjected to heat fixing of the toner images at the fixing portion 20, discharged out of the main assembly of the image forming apparatus by a sheet discharge roller pair 23 through a sheet discharge portion 24 in a state in which an image surface is directed downward.

The fixing portion 20 fixes a plurality of color toner images transferred onto the recording material S and is constituted by a heating roller 21*a* which is rotated and a pressing roller 21*b* which applies heat and pressure to the recording material S by being pressed against the heating roller 21*a* via the recording material S. That is, the recording material S onto which the toner images on the respective photosensitive drums 1 are transferred is conveyed by a fixing roller pair (the rollers 21*a* and 21*b*) during passage thereof in the fixing portion 20 and is also subjected to application of heat and pressure by the fixing roller pair. As a result, the toner images are fixed on the surface of the recording material S.

[Process Cartridge]

Figure 3:
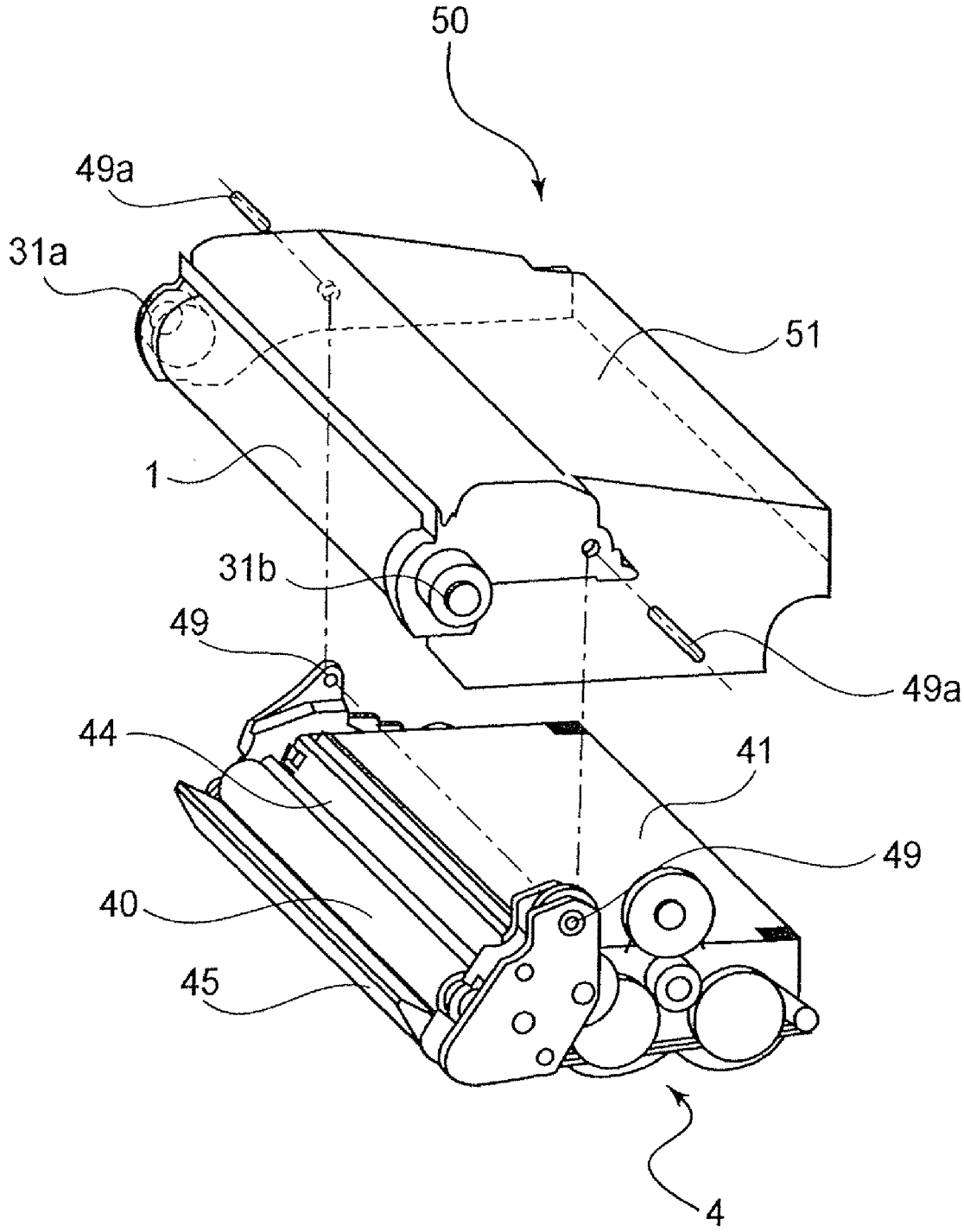
FIG. 3 is a perspective view of the process cartridge.

The process cartridge 8 will be described with reference to FIGS. 2 and 3, wherein FIGS. 2 and 3 are a principal sectional view and a perspective view, respectively, of the process cartridge 7 containing toner. The process cartridges 7*a*, 7*b*, 7*c* and 7*d* containing yellow toner, magenta toner, cyan toner, and black toner, respectively, have the same constitution.

The process cartridge 7 is divided into a drum unit 50 and a developing unit 4. The drum unit 50 includes a drum-shaped electrophotographic photosensitive member as the image bearing member, i.e., the photosensitive drum 1 and the primary charging means 2 and the cleaning means 6. The developing unit 4 includes the developing roller 40 as a developing means for developing the electrostatic latent image on the photosensitive drum 1.

The photosensitive drum 1 is rotatably attached to a cleaning frame 51 through bearing portions 31 (31*a*, 31*b*). Around the photosensitive drum 1, the primary charging means 2 for electrically charging the surface of the photosensitive drum 1 uniformly and a cleaning blade 60 for removing toner remaining on the photosensitive drum 1 are disposed. The toner removed from the surface of the photosensitive drum 1 by the cleaning blade 60 is sent to a waste toner chamber 53 provided to the cleaning frame 51 by a toner conveying mechanism 52.

The developing unit 4 is constituted by the developing roller 40 rotating in an arrow Y direction (clockwise direction) in contact with the photosensitive drum 1, a toner container 41 containing therein the toner, and a developing frame 45. The developing roller 40 is rotatably supported by the developing frame 45 via a bearing member. Around the developing roller 40, a developing blade 44 and a toner supplying roller 43 rotating in an arrow Z direction (clockwise direction) in contact with the developing roller 40 are disposed. In the toner container 41, a conveying mechanism for stirring the toner contained in the toner container 41 and conveying the toner to the toner supplying roller 43 are provided.

The developing unit 4 has a structure such that the entire developing unit 4 is suspended from the photosensitive drum unit 50 by pins 49*a* engaged with supporting portions 49 provided to both end portions of a development frame 45. The developing unit 4 is always urged by a pressing spring 54 so that the developing roller 40 is brought into contact with the photosensitive drum 1 by rotating the developing unit 4 about the supporting portions 49 in a state in which the developing unit 4 is not mounted to the main assembly of the image forming apparatus (printer). To the toner container 41 of the developing unit 4, a rib 46 with which a separating means of the image forming apparatus main assembly A is brought into contact when the developing roller 40 is separated from the photosensitive drum 1 is provided.

[Driving Apparatus]

Next, with reference to FIGS. 4 to 8, an operating mechanism of the process cartridge 7 will be described. In FIG. 4, the process cartridge 7 integrally constituted by the photosensitive drum 1, the charging means 2, the developing unit 4, and the cleaning apparatus 6 is briefly illustrated by showing only the photosensitive drum 1 and the bearing portions 31 (31*a*, 31*b*) for the sake of clarity of explanation of a constitution.

Figure 6:
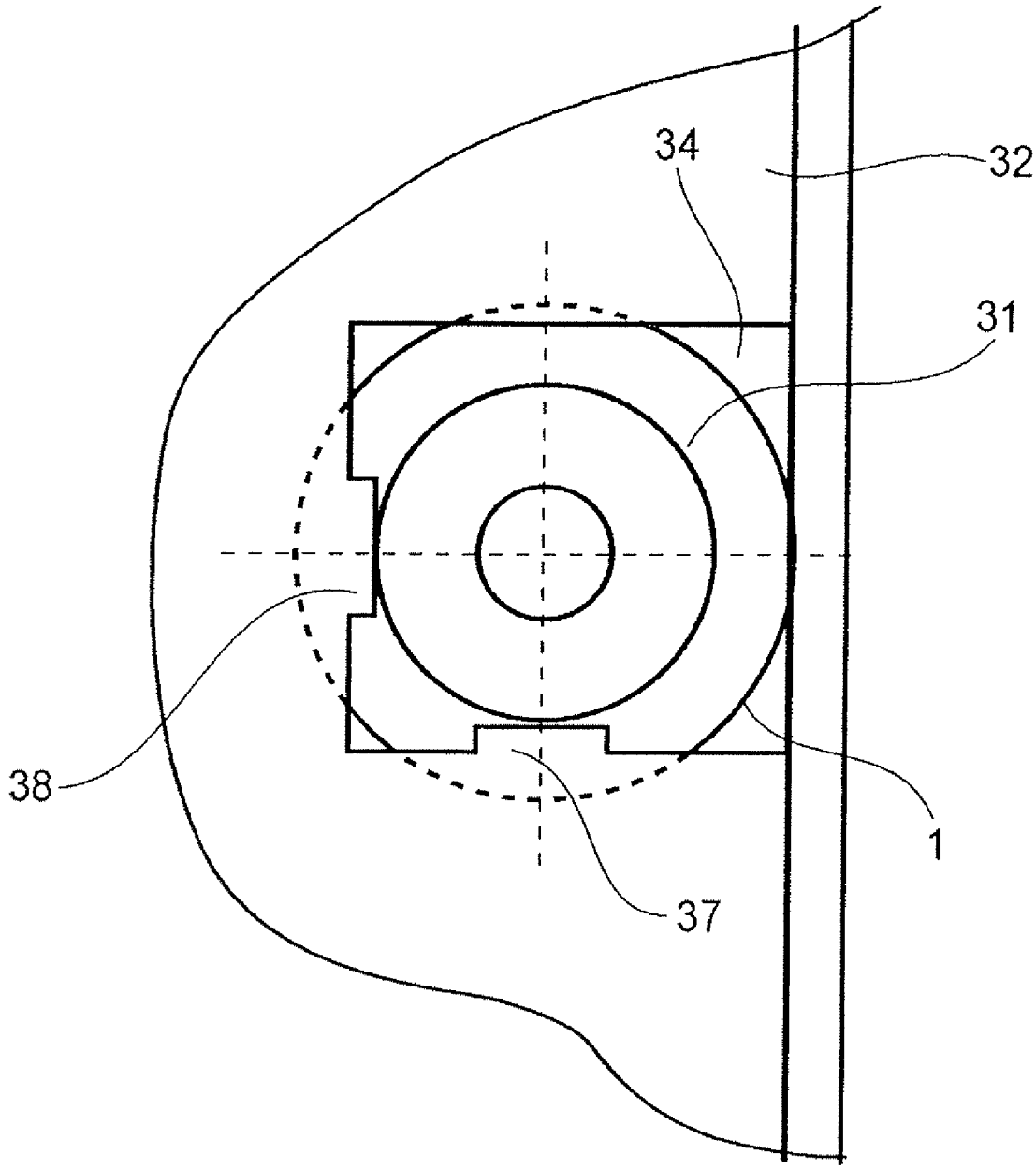

As described above, the process cartridge 7 alone is urged so that the developing roller 40 contacts the photosensitive drum 1 as shown in FIG. 2. The process cartridge 7 is mounted to the apparatus main assembly A by inserting the bearing portion 31 supporting the photosensitive drum 1 into the apparatus main assembly A in a direction indicated by an arrow along first guide grooves (recesses) 34 (34*a*, 34*b*, 34*c*, 34*d*, 34*e*, 34*f*, 34*g*, 34*h*). When the process cartridge 7 is mounted to the apparatus main assembly A, the transfer belt 11 is retracted together with a front-side door of the apparatus main assembly A. As a result, an inserting portion of the process cartridge 7 is opened. When the process cartridge 7 is inserted into the apparatus main assembly A, the process cartridge 7 is positioned with respect to the apparatus main assembly A by pressing the bearing portion 31 of the photosensitive drum 1 against abutting surfaces 37 and 38 of the guide grooves as shown in FIG. 6.

Figure 5:
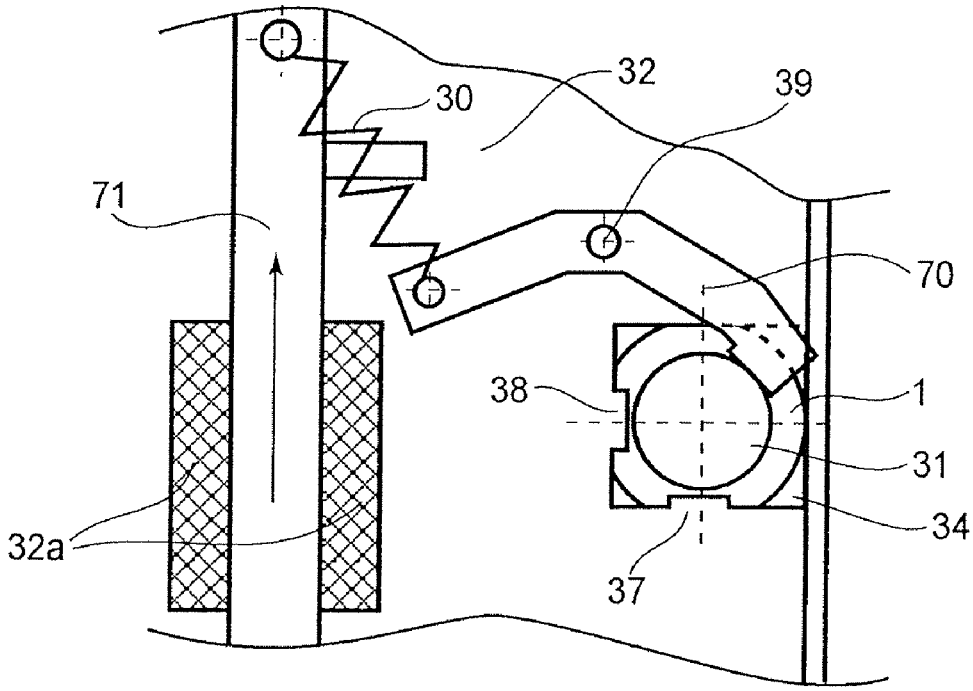
FIGS. 5(*a*), 5(*b*) and 6 are sectional views each showing a positioning portion of the process cartridge with respect to the image forming apparatus.
Figure 5:
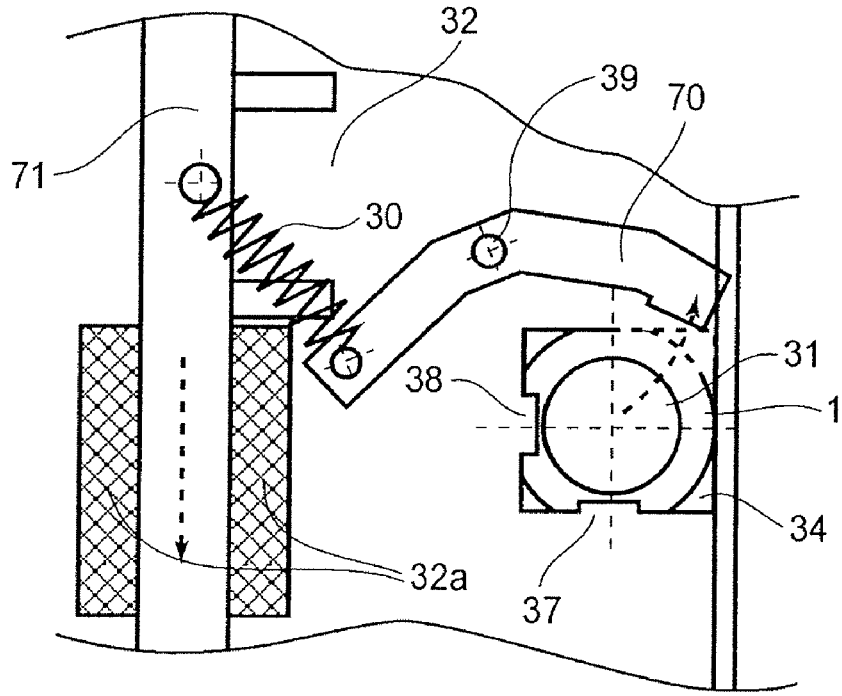

A pressing method of the process cartridge 7 in the apparatus main assembly A is performed in the following manner. As shown in FIG. 5(*a*), shafts 39 are provided to left and right side plates 32 and a pressing lever 70 is rotatably supported by the shaft 39. To the pressing lever 70, one end of a tension spring 30 is connected and the other end of the tension spring 30 is fixed to a rod 71. The rod 71 is movable along a guide portion 32*a* for each of the left and right side plates 32 and is interrelated with an opening and closing operation of the door of the apparatus main assembly A. When the door of the apparatus main assembly A is opened, as shown in FIG. 5(*a*), the pressing lever 70 is moved in a direction indicated by a broken arrow to open the inserting portion of the process cartridge 7, so that the process cartridge 7 is insertably moved. At a rear portion with respect to the inserting direction of the process cartridge 7 into the apparatus main assembly A, as shown in FIG. 1, separating cams 80 (80*a*, 80*b*, 80*c*, 80*d*) as a separating means for separating the developing roller 40 from the photosensitive drum 1 against the urging force of the developing unit 4 are disposed. These separating cams 80 (80*a*, 80*b*, 80*c*, 80*d*) are provided for pushing up ribs 46 (46*a*, 46*b*, 46*c*, 46*d*) provided to the developing units 4 (4*a*, 4*b*, 4*c*, 4*d*) for yellow, magenta, cyan and black, respectively.

Figure 7:
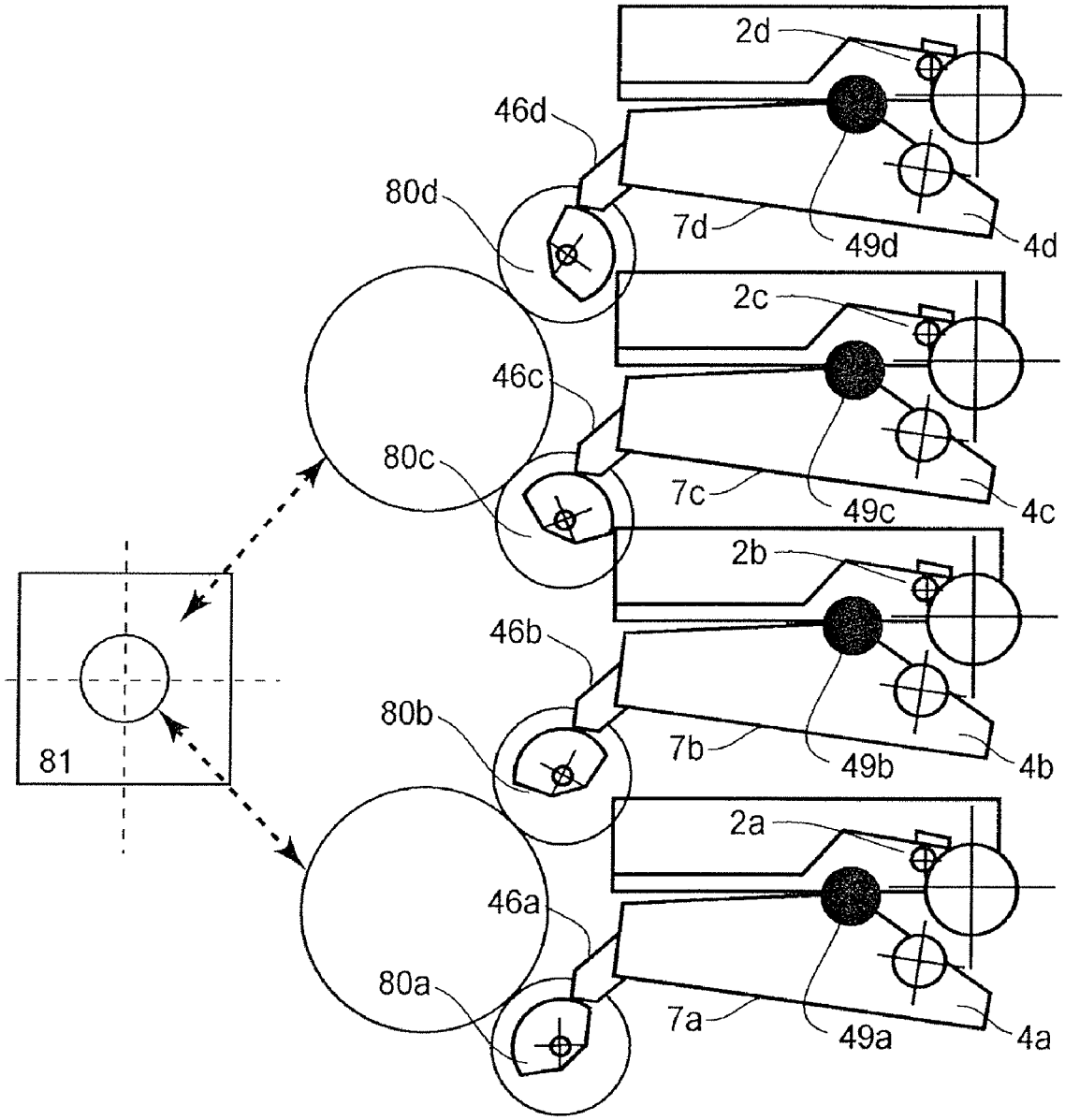
FIG. 7 is a schematic view showing separating cams and their neighborhoods, wherein developing rollers are moved apart from photosensitive drums.

The separating cams 80 are rotated by a driving means (e.g., a stepping motor) 81 shown in FIG. 7 to push the ribs 46, so that the developing units 4 of the process cartridge 7 are fluctuated. As a result, the developing roller 40 is moved in contact with and apart from the photosensitive drum 1. In this embodiment, the following three modes (states) are selectable. One mode is a standby state (third mode) in which the separating cams 80 (80*a*, 80*b*, 80*c*, 80*d*) for all the colors of yellow, magenta, cyan and black contact the ribs 46 (46*a*, 46*b*, 46*c*, 46*d*) with their maximum radii, so that all the developing rollers 40 contact all the photosensitive drum 1. Another mode is a full-color state (first mode) in which the separating cams 80 for all colors contact the ribs 46 with minimum radii, so that all the developing rollers 40 contact all the photosensitive drums 1. The last mode is a monochromatic state (second mode) in which the three developing rollers 40 for yellow, magenta and cyan are separated from the photosensitive drums 1 and only the developing roller 40 for black contacts the photosensitive drum 1. These three (first to third) modes are selectable. In the full-color mode, the developing rollers 40 successively contact the photosensitive drums 1 in the order of yellow, cyan, magenta and black with a predetermined time lag to effect image formation. Similarly, the separating operations of the developing rollers 40 from the photosensitive drums 1 can be performed successively with a predetermined time lag.

When the process cartridges 7 are mounted to the apparatus main assembly A, as shown in FIG. 7, all the separating cams for four colors are placed in a contact state with the ribs 46. Accordingly, when the process cartridges 7 are inserted, the ribs 46 provided to the developing unit 4 run on the separating cams 80, so that the developing rollers 40 are separated from the photosensitive drums 1. This separation state is kept during a power-off period or a period in which the development is not performed. Accordingly, during a period in which the process cartridge 7 is not used in a mounted state to the photosensitive drum 1, the developing roller 40 is always placed in the separation state from the photosensitive drum 1. As a result, it is possible to suppress deformation of the developing roller 40 caused due to contact of the developing roller 40 with the photosensitive drum 1 for a long time.

Then, image forming modes will be described. The color image forming apparatus shown in FIG. 1 is constituted so that it can perform an operation for bringing the transfer belt 11 into contact with the photosensitive drum 1 (contacting operation) and an operation for separating the transfer belt 11 from the photosensitive drum 1 (separating operation). Hereinafter, these operations are inclusively referred to as a contact/separation operation. During recording, the full-color mode (first mode) for performing multi-color recording by superposing a plurality of color toners and the monochromatic mode (second mode) for performing recording with a single color toner are selectable.

[Image Forming Operations in Full-Color Mode and Monochromatic Mode and Transfer Member Moving Mechanism]

Operations in the full-color and monochromatic print modes will be described with reference to FIGS. 8 and 9 and a moving mechanism for the transfer member will be described with reference to FIGS. 10-12.

Figure 8:
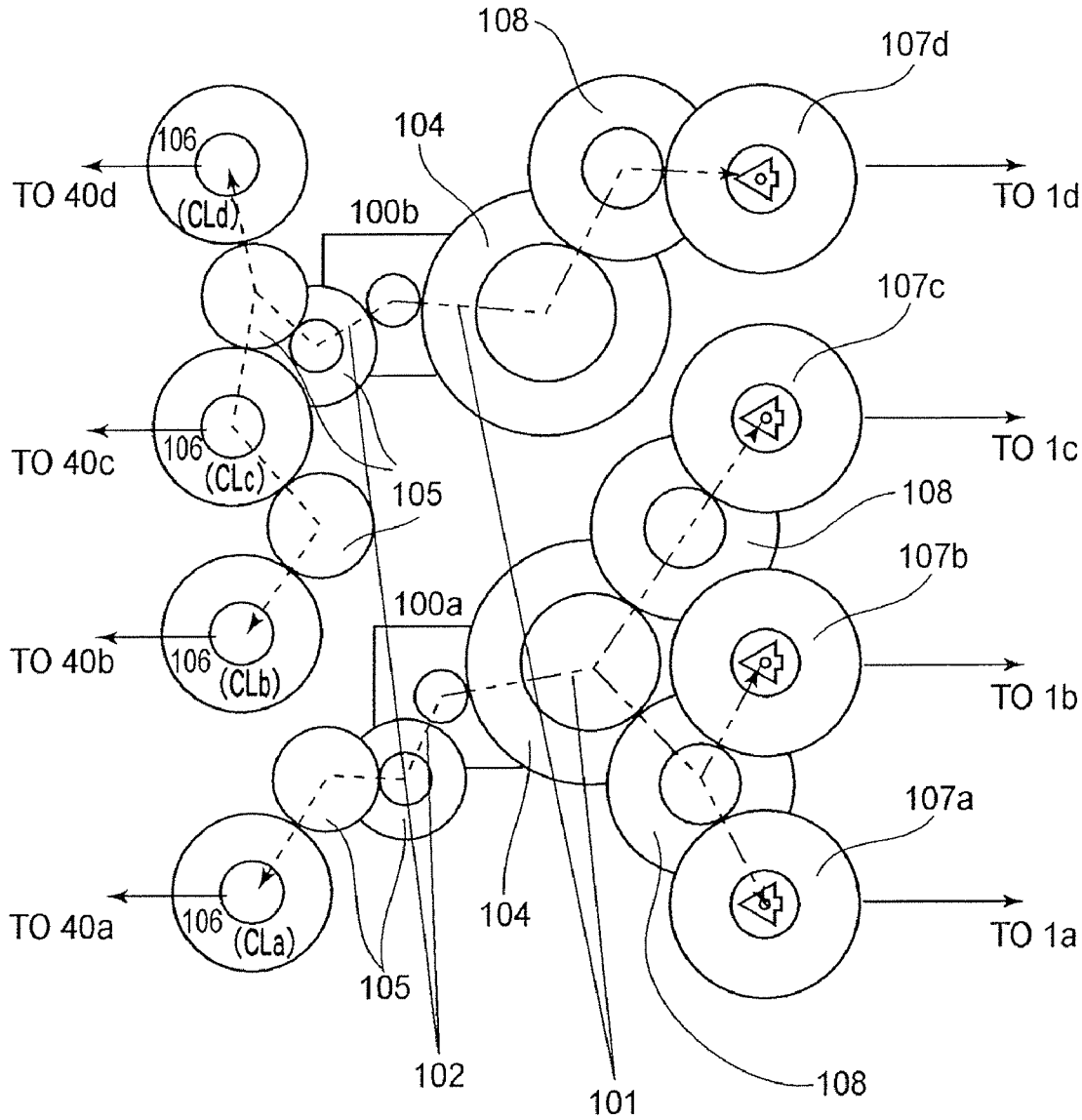
FIG. 8 is a schematic view for illustrating a constitution for driving process cartridges.

First, an outline of an entire driving system is shown in FIG. 8. As shown in FIG. 8, two motors 100*a* and 100*b* drive the process cartridges 7. The motor 100*a* drives an idler gear 104 as a next stage of the motor 100*a*, and preceding gears 108 and drum driving gears 107*a*, 107*b* and 107*c* along a drum driving train 101. As a result, the photosensitive drums 1*a*, 1*b* and 1*c* of the process cartridges for yellow, magenta and cyan are rotated. At the same time, the motor 100*a* is connected to a clutch gear 106 having a clutch CLa via an idler gear 105 along a developing roller driving train 102. The clutch gear 106 is finally engaged with an input gear (not shown) of the yellow process cartridge to drive the developing roller 40*a*.

The other motor 100*b* drives an idler gear 104 as a next stage of the motor 100*b*, a preceding gear 108, and a drum driving gear 107*d* along a drum driving train 101 similarly as in the case of the motor 100*a*. As a result, the photosensitive drum 1*d* of the black process cartridge is rotated. At the same time, the motor 100*b* is connected to clutch gears 106 having clutches CLb, CLc and CLd via idler gears 105 along a developing roller driving train 102. The clutch gears 106 are finally engaged with input gears (not shown) of the magenta process cartridge, the cyan process cartridge, and the black process cartridge to drive the developing rollers 40*b*, 40*c* and 40*d*.

The recording operations in the full-color print mode and the monochromatic print mode will be described separately.

In the case of the full color print mode (first mode), when the recording operation is started by a printing signal, the above-described two motors 100*a* and 100*b* for driving the process cartridges and a driving motor for the transfer belt are rotated. In this case, all the clutches CLa to CLd for driving the developing rollers are disengaged, so that all the developing rollers are not rotated.

Figure 9:
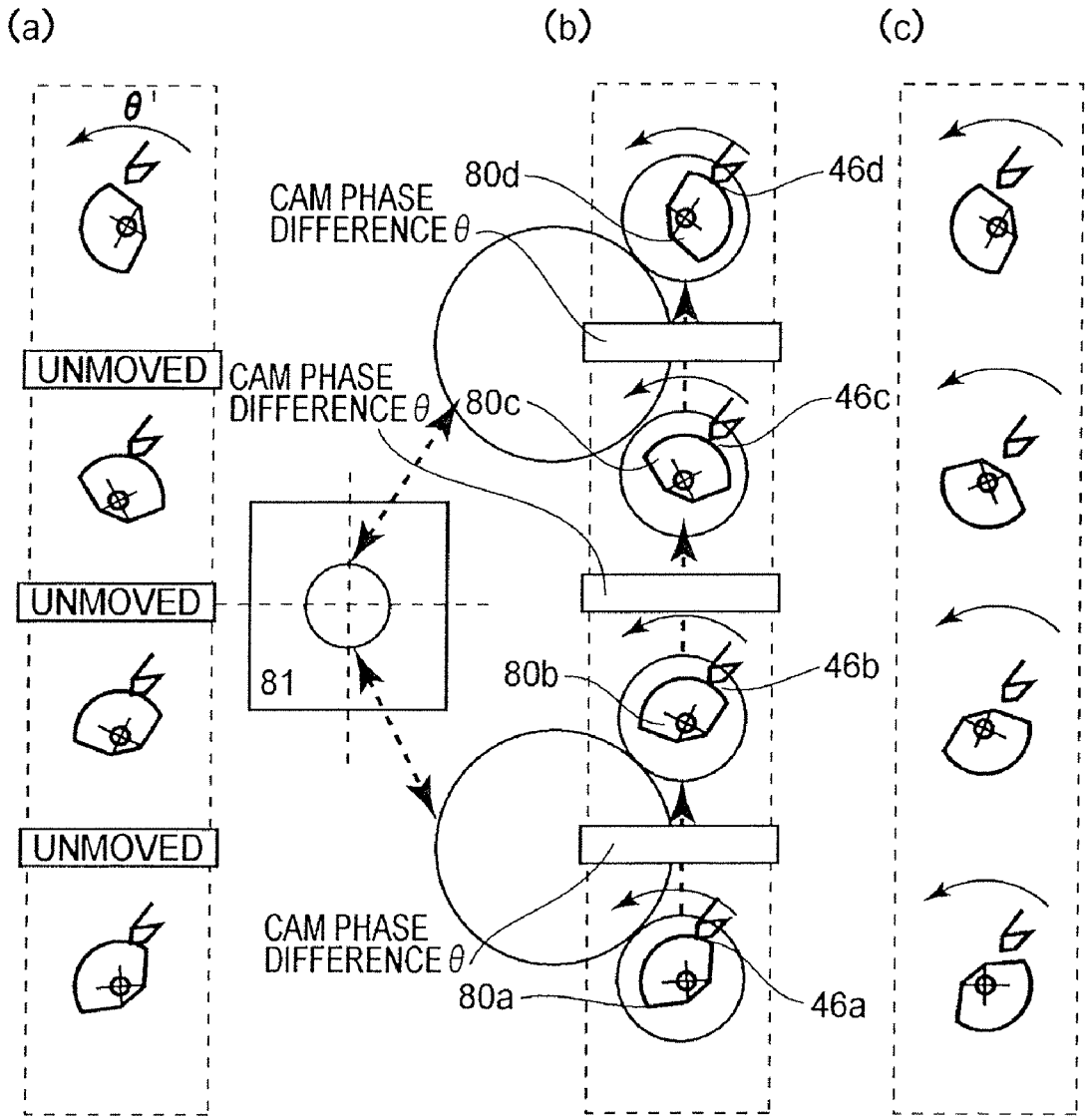
FIGS. 9(*a*), 9(*b*) and 9(*c*) are explanatory views showing motions of the separating cams.

Next, as shown in FIGS. 9(*a*) to 9(*c*), when a stepping motor 81 is rotated, the separating cams 80 (80*a*, 80*b*, 80*c*, 80*d*) are rotated in a counterclockwise direction. At that time, the first clutch CLa provided to the developing roller driving train is turned on to rotate the first developing roller 40*a*. Immediately thereafter, the developing roller 40*a* and the photosensitive drum 1 are brought into contact with each other, so that image formation is started. In a similar manner, with a predetermined lag (cam phase difference θ), the second, third, and fourth clutches CLb, CLc, and CLd are turned on to rotate the second, third, and fourth developing rollers 40*b*, 40*c* and 40*d*, respectively. The developing rollers 40*b*, 40*c* and 40*d* successively contact the photosensitive drums 1*b*, 1*c* and 1*d*, respectively, to place the image forming apparatus in the full-color print mode as shown in FIG. 9(*c*). In the full-color print mode, the transfer belt 11 contacts all the photosensitive drums 1 as shown in FIG. 11. Further, all the transfer rollers 12 are moved to contact the transfer belt 11.

After the above-described first image formation is completed, the stepping motor 81 is further rotated to rotate the separating cams 80 (80*a*, 80*b*, 80*c*, 80*d*). First, the first developing roller 40*a* is separated from the photosensitive drum 1 and then the clutch CLa is turned off (disengaged) to stop the rotation of the first developing roller 40*a*. Thereafter, in the same manner as in the case of the contact between the developing rollers and the photosensitive drums, with a predetermined time lag, the second to fourth developing rollers 40*b*, 40*c* and 40*d* are successively separated from the photosensitive drums 1*b*, 1*c* and 1*d*, respectively, to complete the image formation in the full-color print mode.

In the case of the monochromatic print mode (second mode), similarly as in the transfer from the state of FIG. 9(*b*) to the state of FIG. 9(*c*), the stepping motor 81 is rotated to rotate only the black separating cam 80*d* by an angle θ' in a counterclockwise direction as shown in FIG. 9(*a*). Incidentally, of the driving trains for the contact/separation operation of the developing rollers, clutches (not shown) for transmitting or removing a driving force from the motor 81 to the respective separating cams 80*a*, 80*b* and 80*c* for yellow, cyan and magenta are provided to the driving trains for these separating cams. Accordingly, in the second mode, by turning off (disengaging) the clutches provided to the driving train for the separating cams 80*a*, 80*b* and 80*c*, the driving force is not transmitted from the motor 81 to the respective separating cams and is transmitted to only the separating cam 80*d*, thus rotating only the separating cam 80*d*. As a result, only the fourth developing roller 40*d* contacts the photosensitive drum 1*d* and the first to third developing rollers 40*a*, 40*b* and 40*c* do not contact the photosensitive drums 1*a*, 1*b* and 1*c*, so that it is possible to ensure the monochromatic print mode. In the monochromatic print mode, the transfer belt 11 is separated from the photosensitive drums except for the image forming portion for the color used in the monochromatic print mode by retracting the transfer rollers 12*a*, 12*b* and 12*c* from the photosensitive drums 1*a*, 1*b* and 1*c* as shown in FIG. 12. As a result, it is possible to maintain a high-quality image output until an end of product life at portions for the colors which are not used in the monochromatic print mode while preventing waste of the photosensitive drums and the transfer belt. When the monochromatic print mode is completed, the separating cams 80 (80*a*, 80*b*, 80*c*, 80*d*) are further rotated to separated positions shown in FIG. 9(*c*) in a normal (counterclockwise) direction, so that the developing rollers for all the four colors are placed in the separated state.

Figure 10:
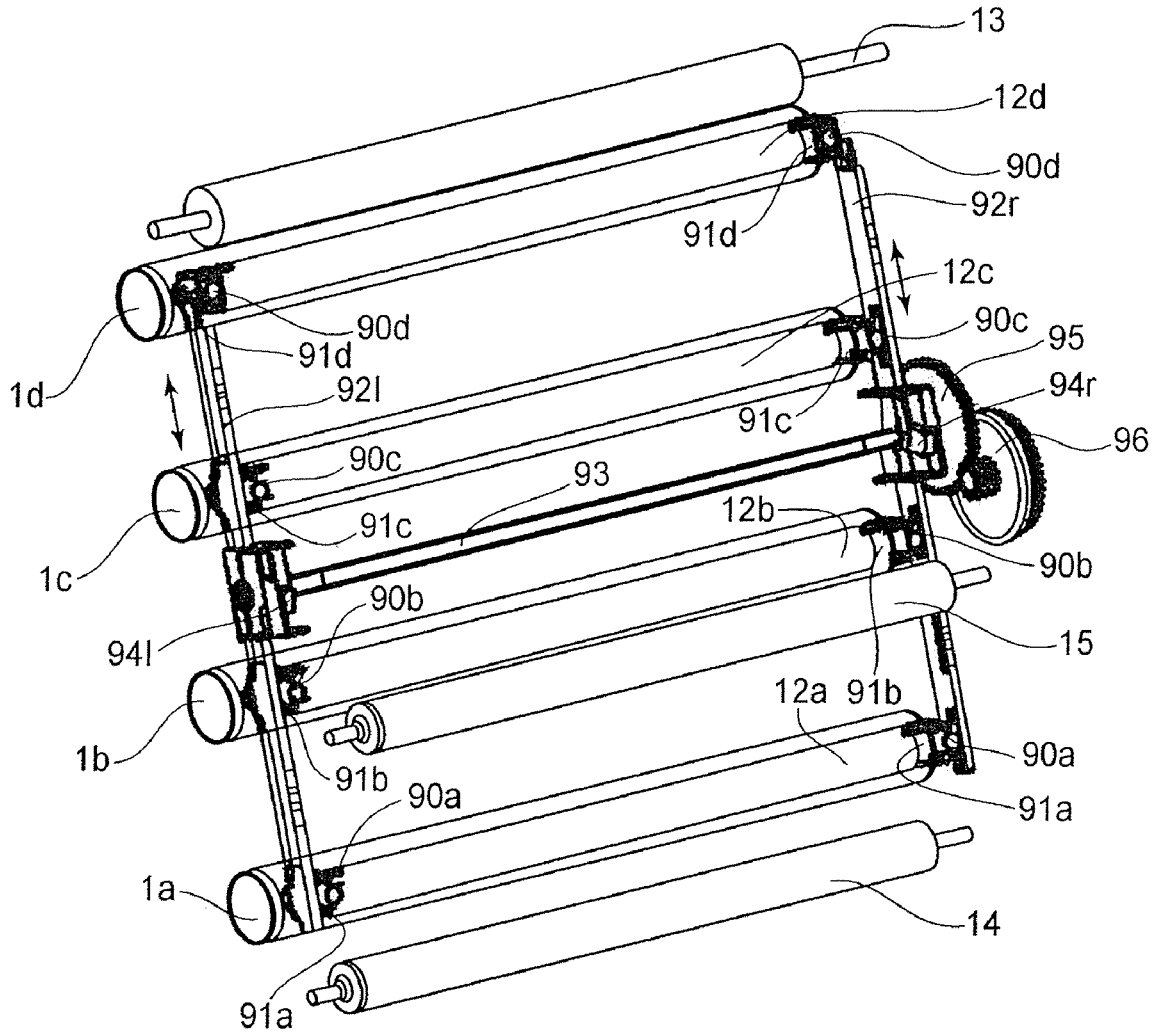
FIG. 10 is a perspective view showing a moving mechanism for transfer members.

With reference to FIG. 10, the moving mechanism of the transfer member will be specifically described.

A gear train is constituted so as to extend from an unshown driving source to a separating gear 95 through a separating gear 96 while ensuring a necessary reduction ratio. A separating shaft 93 and separating cams 94*l* and 94*r* disposed at both ends of the separating shaft 93 are provided in coaxial alignment with the separating gear 95. The separating gear 95 and the separating gear 96 have smaller gears having the number of teeth of 40 and 10, respectively, and a reduction ratio therebetween is 1/4. In coaxial alignment with the separating gear 96, an unshown solenoid and an unshown gear having partly omitted teeth are provided. By turning on and off the solenoid, control of one rotation of the separating gear 96 and control of ¼ rotation of the separating gear 95 are realized. A similar function can also be realized by control of an angle of rotation with the stepping motor or the use of a driving control means such as an electromagnetic clutch, other than the combination of the solenoid with the gear having partly omitted teeth.

By the rotational control of the separating gear 95, separating rods 92*l* and 92*r* slide via the separating cams 94*l* and 94*r* in directions indicated by a double-pointed arrow substantially in parallel with an arrangement direction of the photosensitive drums 1, i.e., substantially perpendicularly to a longitudinal direction of the photosensitive drums 1. Following the sliding of the separating rods 92*l* and 92*r*, transfer roller bearing portions 91*a* to 91*d* are moved in identical or opposite direction with respect to an axial direction of transfer member pressing springs 90*a* to 90*d*. As a result, the transfer rollers are moved toward or apart from the photosensitive drums. By this movement of the transfer rollers 12*a* to 2*d*, the photosensitive drums 1*a* to 1*d* and the transfer belt 11 are contactable and separable.

Figure 11:
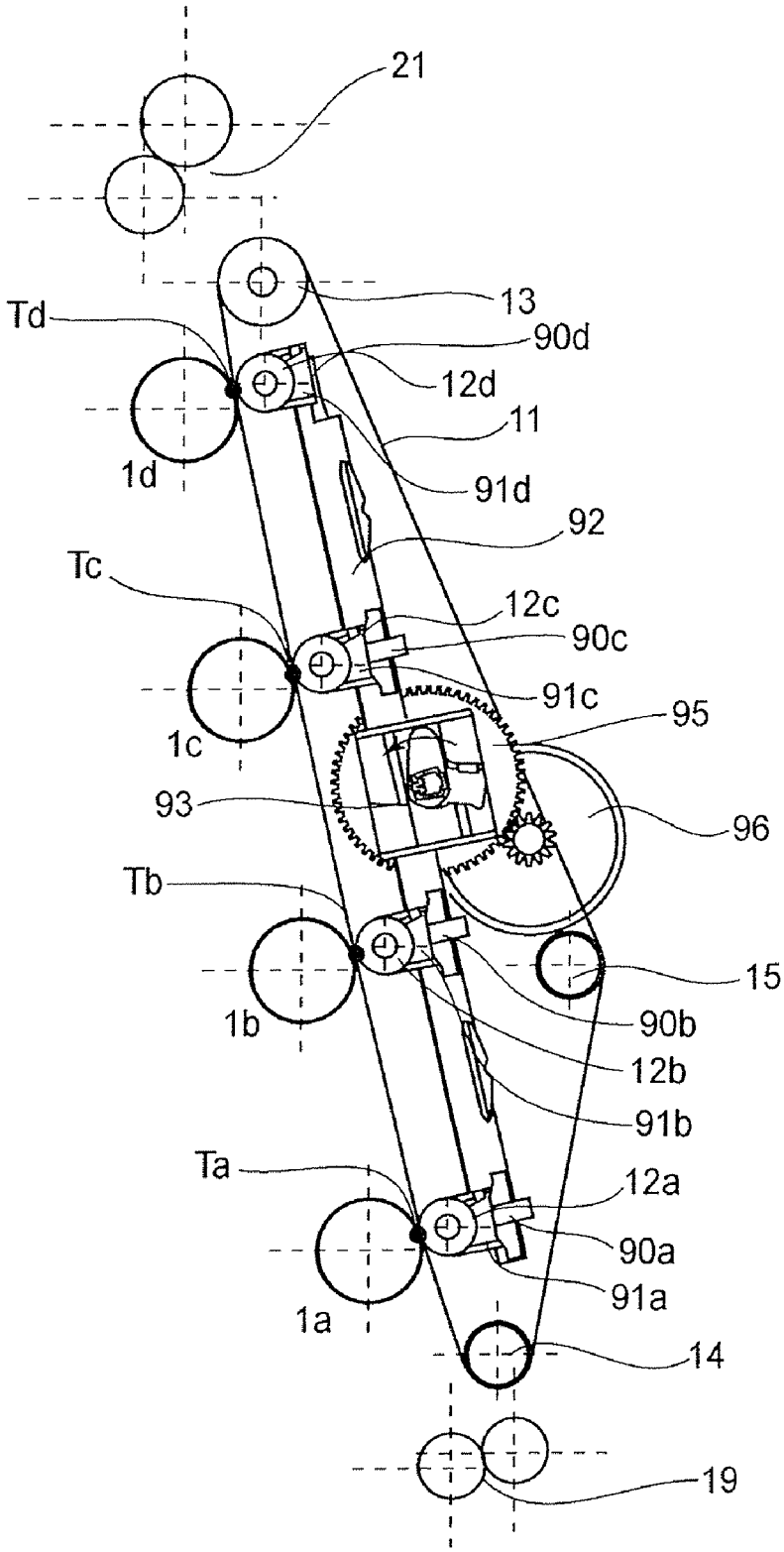
FIG. 11 is a schematic view showing a contact state between a transfer belt and the photosensitive drums in a full-color (print) mode.
Figure 12:
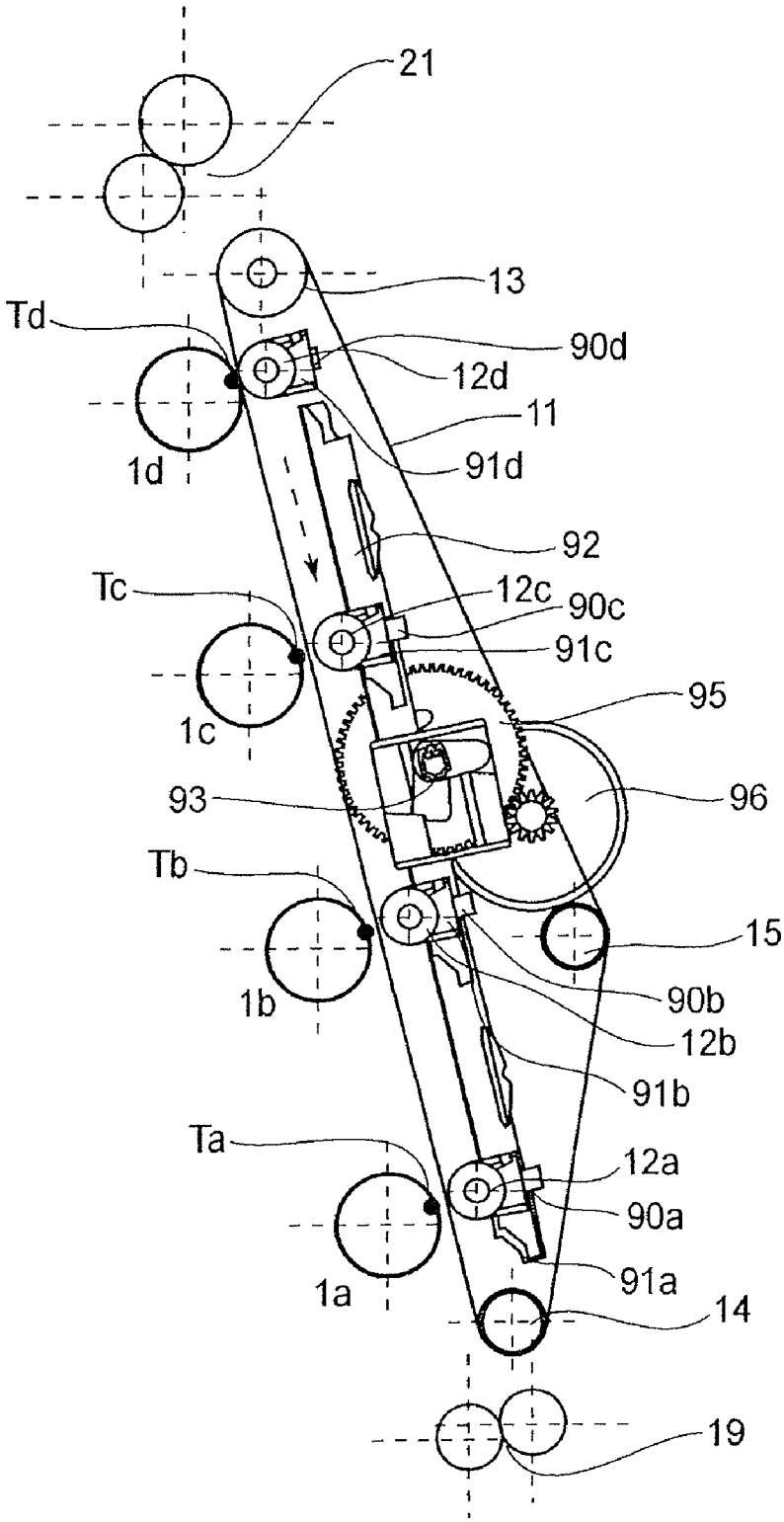
FIG. 12 is a schematic view showing a state in which a part of the photosensitive drums is separated from the transfer belt in a monochromatic (print) mode.

FIG. 11 is a sectional view showing a state during full-color printing (first mode), and FIG. 12 is a sectional view showing a state during monochromatic printing (second mode).

In order to change the printing state from the state of FIG. 11 to the state of FIG. 12, the separating gear 95 is rotated 270 degrees in an solid line arrow direction (counterclockwise direction). As a result, the separating rod 92 slides in a broken line arrow direction shown in FIG. 12 to move the transfer rollers 12 and the transfer belt 11 away from the photosensitive drums 1.

Figure 13:
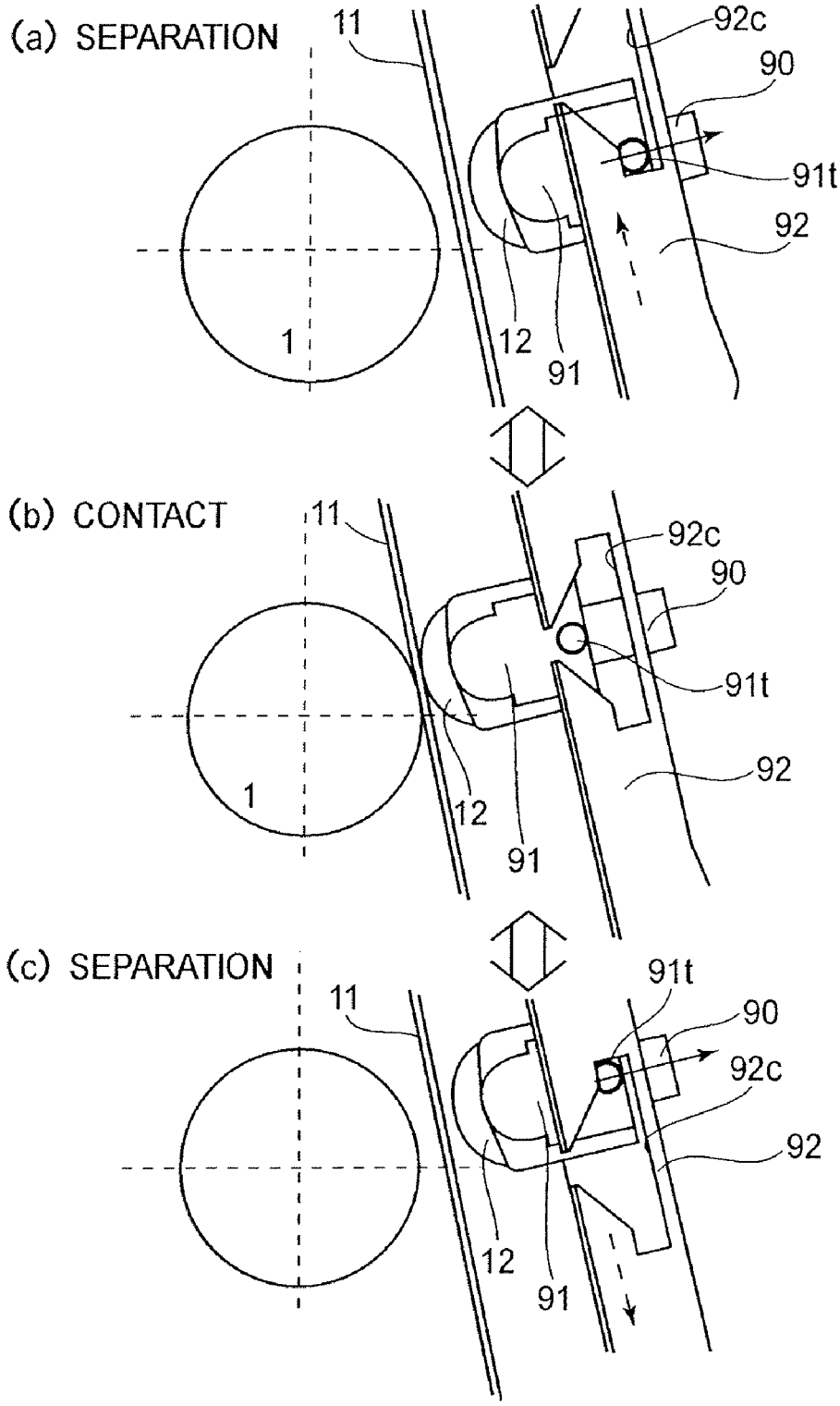
FIGS. 13(*a*), 13(*b*) and 13(*c*) are enlarged views showing transfer rollers, shafts thereof, and their neighborhoods during contact and separation between the transfer belt and the photosensitive drums.

A relationship between the separating rod 92 and the transfer roller bearing portion 91 during movement of the transfer roller 12 is shown in FIGS. 13(*a*) to 13(*c*).

The separating rod 92 is provided with a hook portion 92*c*, and the hook portion 92*c* shown in FIG. 12(*b*) slides in a broken-line arrow direction shown in FIG. 12(*a*) or FIG. 12(*c*) to move a boss portion 91*t* of the transfer roller bearing portion 91. By such an operation of the hook portion 92*c*, movement of the transfer member is realized.

Figure 14:
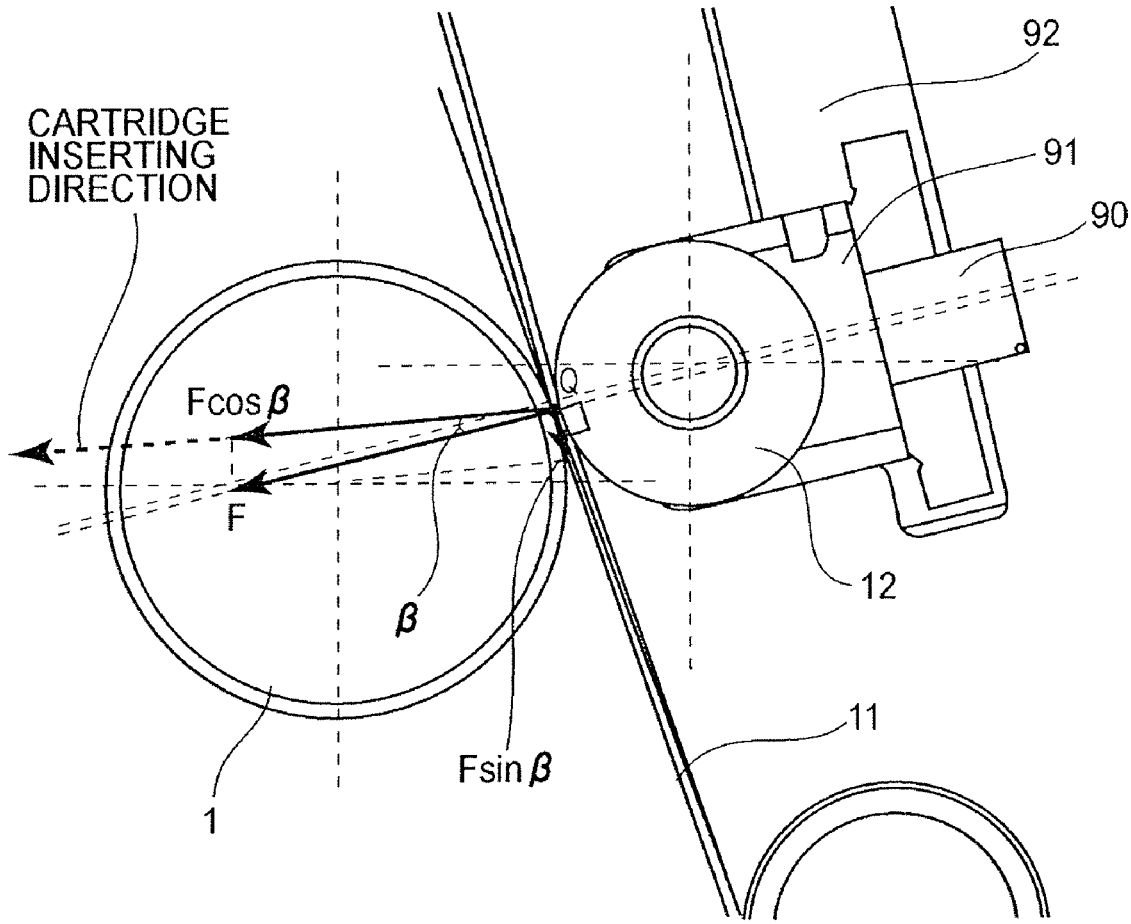
FIG. 14 is an explanatory view showing a relationship between a movement direction (contact/separation direction) of the transfer roller and a movement direction of the process cartridge.

With reference to FIG. 14, a constitution for moving the process cartridge 7 by a transfer pressure applied by the transfer member pressing spring 90 will be described. The transfer member pressing spring 90 brings the transfer belt 11 into contact with the photosensitive drum 1 at a position of a point Q through the transfer roller bearing portion 91 and the transfer roller 12. The transfer member pressing springs exerts a pressing force of about 2.45 N (250 gf) for one side on the transfer belt 11, so that a total pressing force F is about 4.9 N (500 gf). Incidentally, a fresh process cartridge 7 has a weight corresponding to about 9.8 N (1 kgf) per one cartridge.

An inserting direction of the process cartridge 7 into the apparatus main assembly apparatus is a broken-line arrow direction shown in FIG. 14 and assuming that an angle thereof with a pressing direction is taken as β, a component of the force F in the process cartridge inserting direction is represented by $F\cos\beta(>0)$. Even when a frictional force between the process cartridge 7 and a receiving portion of the apparatus main assembly A is taken into consideration, the above-described transfer pressure is enough to pressing the process cartridge 7 into the apparatus main assembly A. Further, the transfer pressure has a vector component in a direction (inserting direction) in which the process cartridge 7 opposing the transfer roller 12 through the transfer belt 11 is moved, with respect to the movement direction of the transfer roller 12 as the transfer member. For this reason, it is possible to move the process cartridge 7 to a predetermined position in the apparatus main assembly A by the transfer pressure described above.

There as some cases where the process cartridge 7 cannot be moved to the predetermined position of the apparatus main assembly A in an operation for inserting the process cartridge 7 into the apparatus main assembly A. This is because the rib 46 can get snagged on the separating cam 80. In such cases, the above-described contact/separation operation of the developing roller by the separating cam 80 is carried out to remove a reaction force from the separating cam 80 to the process cartridge 7. By separating the separating cam 80 from the process cartridge 7 to disengage the separating cam 80, it is possible to reliably move the process cartridge 7 to the predetermined position in the apparatus main assembly A. Particularly, by separating the separating cam 80 from the process cartridge 7 during a separating operation by the moving mechanism performed before start of detection by a discrimination means described later, it is possible to further reliably move the process cartridge 7 to the predetermined position in the apparatus main assembly A by the above-described transfer pressure.

In the above-described constitution, by turning the solenoid on and off, it is possible to change the state of the transfer belt 11 to two states including a contact state and a separation state with respect to the photosensitive drum 1, but the image forming apparatus main assembly cannot recognize that the transfer belt 11 is placed in which of the two states. In this embodiment, a current flowing during application of a voltage to any one of transfer portions Ta (yellow), Tb (magenta) and Tc (cyan) to be placed in the two (contact and separation) states is detected and compared with a preset value, so that discrimination between the contact state and the separation state can be made.

[Transfer Current Detecting Method]

Figure 15:
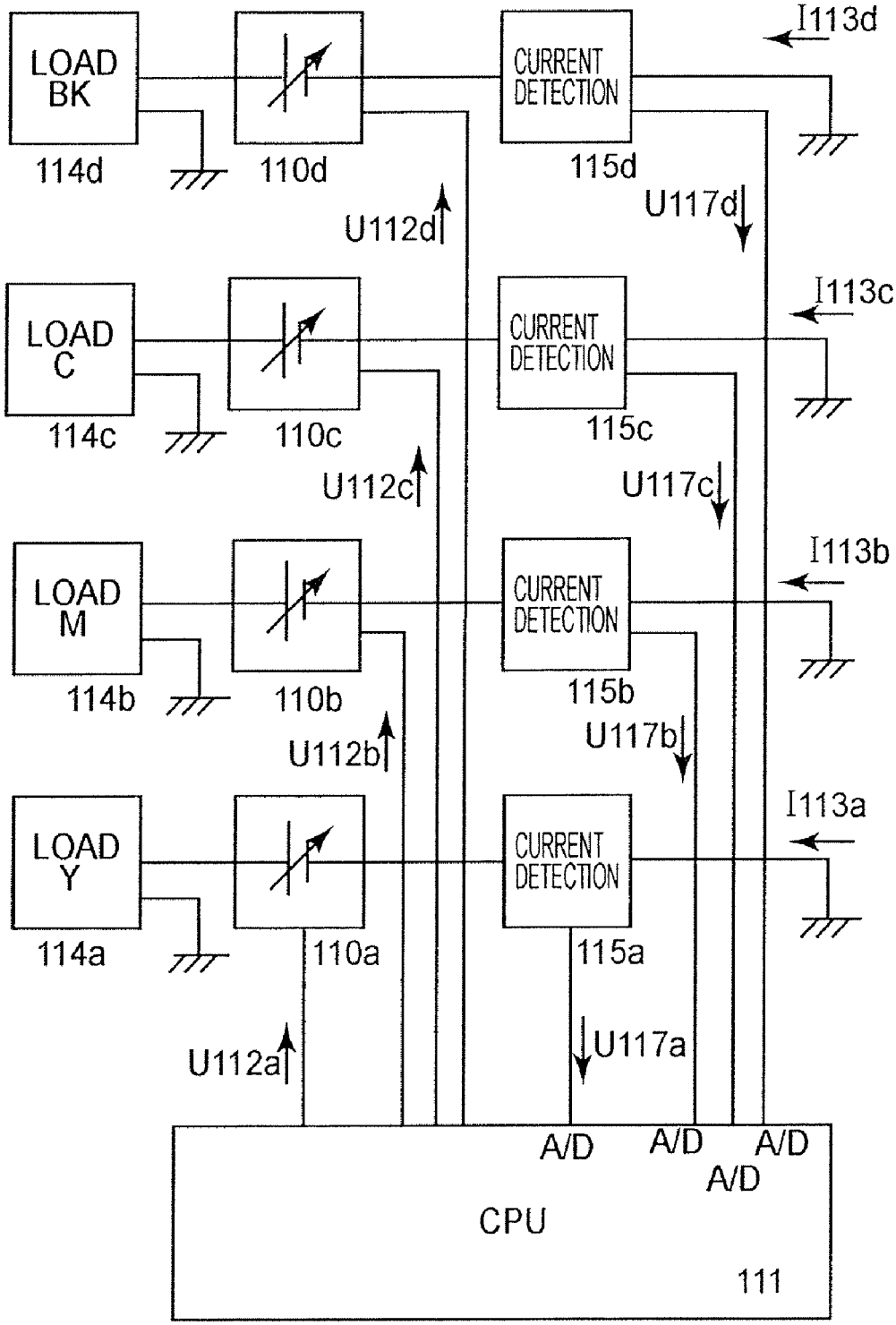
FIG. 15 is a schematic wiring diagram showing wiring around transfer bias power sources.
Figure 16:
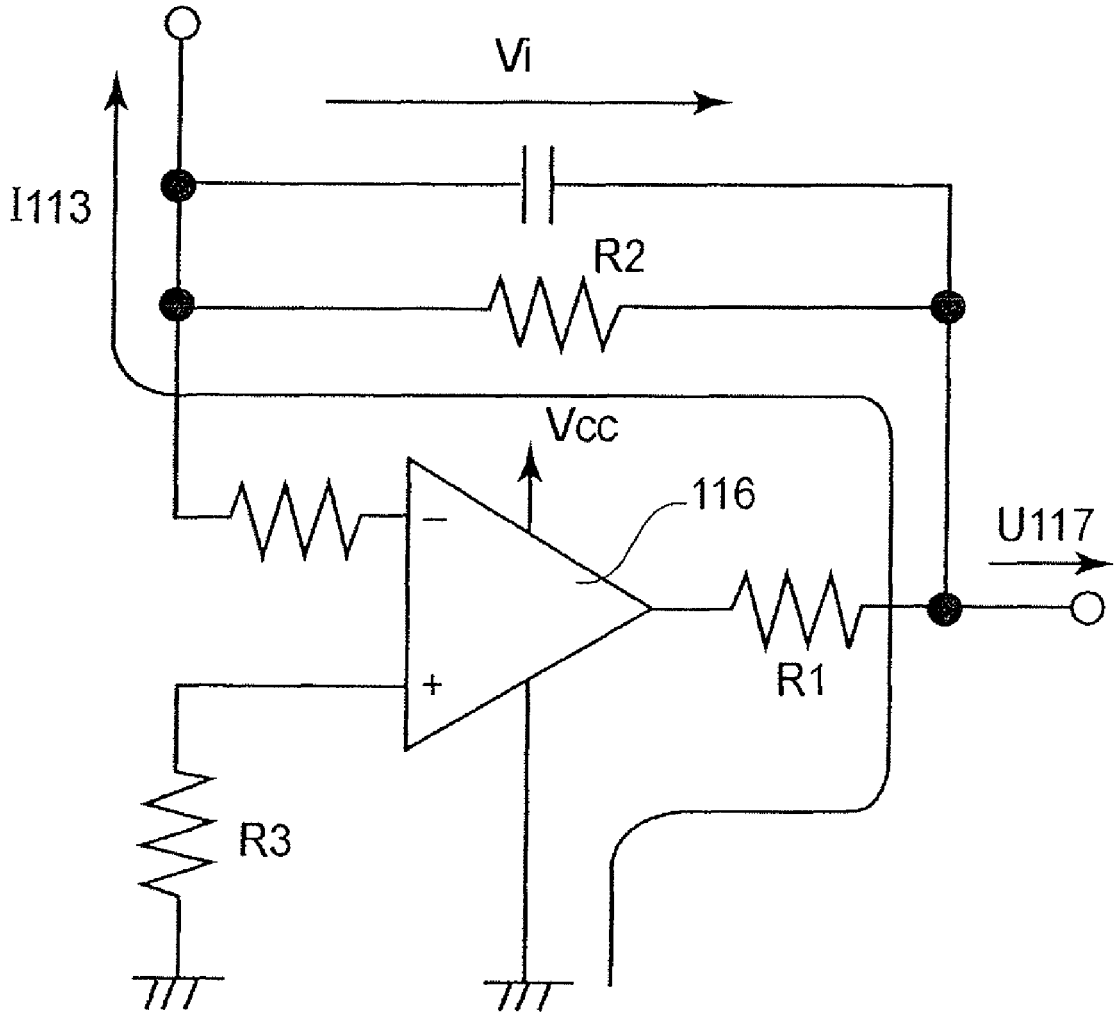
FIG. 16 is a diagram showing a circuit for detecting a transfer current.

The discrimination means for discriminating the two (contact and separation) states by detecting the transfer current will be described with reference to FIGS. 15 to 17. FIG. 15 is an example of a transfer bias wiring diagram, wherein a transfer bias circuit and a transfer current detecting circuit are provided to each of the image forming portions for yellow, magenta, cyan and black. FIG. 16 shows the transfer current detecting circuit, and FIGS. 17(*a*) and (*b*) show schematic views showing transfer portions for yellow and black shown in FIG. 15 during contact of the transfer (conveying) belt with the photosensitive drums.

A detecting procedure of the transfer current at the yellow image forming portion will be described. In FIGS. 15 to 17, alphabetic characters a, b, c and d for reference numerals represent portions or elements for yellow, magenta, cyan and black, respectively. Hereinbelow, a constitution of the yellow image forming portion will be described but other image forming portions for magenta, cyan and black have the same constitution.

A transfer bias circuit 110*a* supplies a transfer bias to the transfer roller 12*a* in order to transfer a toner image formed on the photosensitive drum 1*a* onto the recording material conveyed by the transfer belt 11. In the case of an image forming apparatus utilizing a negatively chargeable toner, a high voltage of a positive polarity is ordinarily used as the transfer bias.

A voltage value of the high voltage is controllable depending on an operation environment of equipment or the type of the recording material or the like by a signal U112*a* from a CPU 111 of an engine controller (not shown) for controlling image formation. In the case where the transfer belt 11 contacts the photosensitive drum 1*a*, when the transfer bias is applied, most of a transfer current I113*a* passes through the transfer roller 12, the transfer belt 11, the recording material, the photosensitive drum 1*a*, and the drum shaft, in this order, constituting a load 114*a* of the transfer bias circuit 110*a* and flows into a transfer current detector 115*a* through the ground. The transfer current I113*a* having flowed into the transfer current detecting circuit flows from the ground of an operational amplifier 116 of the transfer current detecting circuit shown in FIG. 16 in a direction indicated by an arrow through an output terminal, a protective resistance R1, and a resistance R2. A positive (+) terminal of the operational amplifier is connected to the ground via an impedance-matching resistance R3. Since the positive (+) terminal and a negative (−) terminal of the operational amplifier constitute an imaginary short circuit, so that the negative (−) terminal can also be considered as the ground. When the transfer current I113*a* flows, a voltage Vi is generated on the basis of an imaginary ground for the negative (−) terminal of the operational amplifier. The voltage Vi is represented by the following equation (1):

$$Vi=Itr\times Ra \quad (1),$$

wherein Itr represents a transfer current and Ra represents a value of the resistance R2. A value of an output signal U117 from the transfer current detecting circuit is Vi.

More specifically, the transfer current detecting circuit converts the transfer current I113*a* into the voltage (output) signal U117*a* which is proportional to a value of the current and outputs the voltage signal U117*a* to a D/A port of the CPU 111. The CPU 111 effects control so that the toner image formed on the photosensitive drum is optimally transferred onto the recording material by correcting an output voltage to the transfer bias circuit 110*a* through a signal U112*a* on the basis of the voltage signal U117*a*, lifetime information, etc. In a similar detecting procedure, it is also possible to detect transfer currents at other image forming portions for magenta, cyan and black. Further, in addition to the detecting procedure, it is possible to employ a system for correcting an output voltage of the transfer bias circuit 110*a* on the basis of environmental information obtained by an unshown environmental sensor (environment detecting means) for detecting ambient temperature or humidity of the apparatus main assembly.

[Transfer Current During Contact/Separation of Transfer (Conveying) Belt]

Next, with reference to FIGS. 17(*a*) and 17(*b*) and FIGS. 18(*a*) and 18(*b*), the transfer current during contact and separation of the transfer belt 11 will be described. FIGS. 17(*a*) and 17(*b*) are schematic views for illustrating yellow and black transfer portions during contact between the transfer belt 11 and the photosensitive drums 1, and FIGS. 18(*a*) and 18(*b*) are schematic views for illustrating the yellow and black transfer portions during separation of the transfer belt 11 from the photosensitive drum 1*a*. FIG. 17(*b*) and FIG. 18(*b*) specifically show these transfer portions and their neighborhoods. In this embodiment, the transfer current during the contact and separation of the transfer belt 11 will be described by focusing attention on the yellow image forming portion.

When the transfer bias is applied, as described above, most of the transfer current I113*a* passes through the transfer roller 12, the transfer belt 11, the recording material, the photosensitive drum 1*a*, and the drum shaft, in this order, constitution the load 114*a* of the transfer bias circuit 110*a* and flows into the transfer current detector 115*a* through the ground. This current path will be described more specifically.

During the printing, the transfer belt 11 and the photosensitive drum 1*a* contact each other and the recording material is conveyed therebetween. An electric resistance value of the recording material varies depending on the type of the recording material or an environment, thus changing a value of the transfer current. For this reason, in this embodiment, the case of no recording material will be described.

Figure 17:
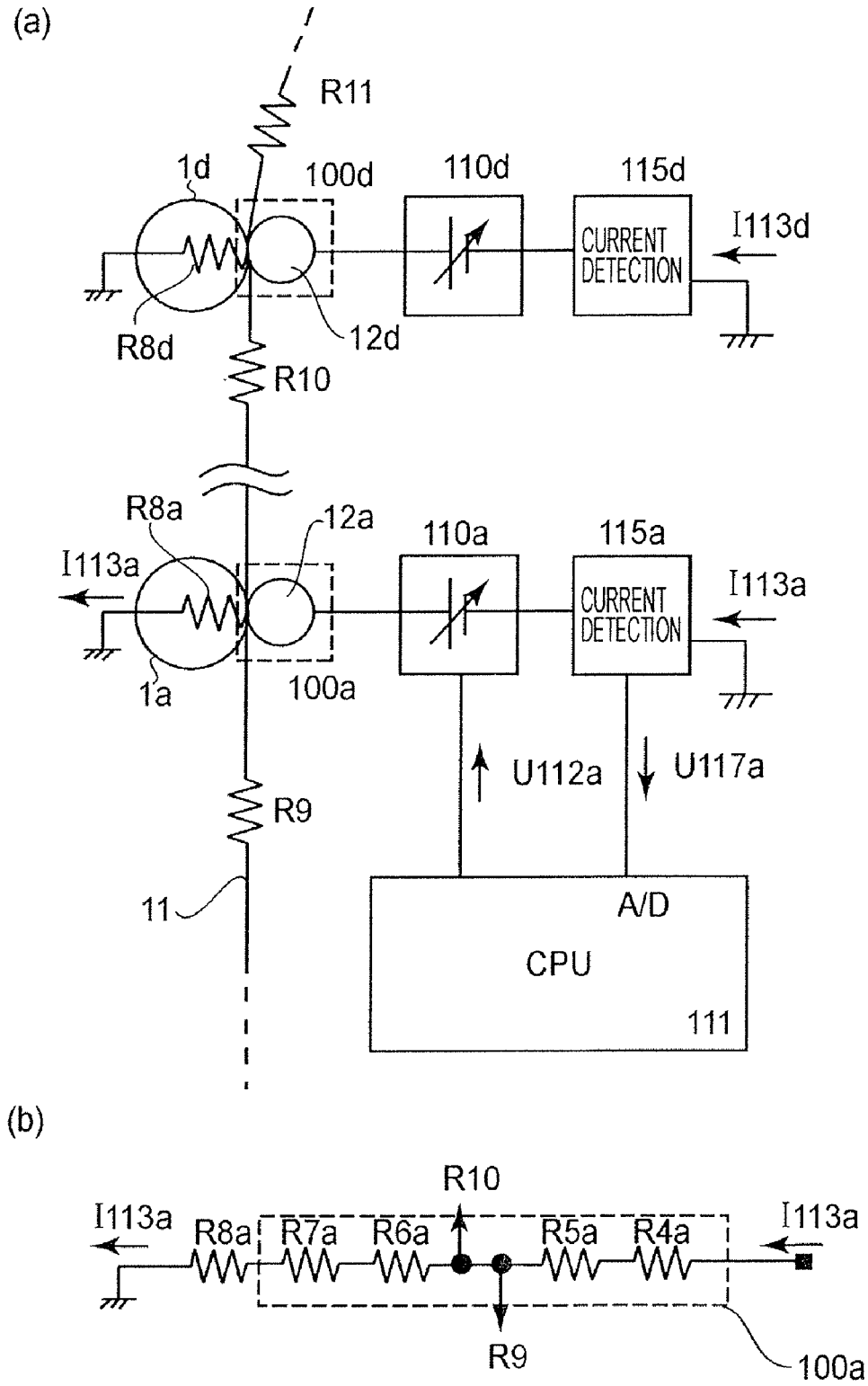
FIGS. 17(*a*) and 17(*b*) are schematic diagrams for illustrating yellow and black transfer portions during contact between the transfer belt and the photosensitive drums.

As shown in FIGS. 17(*a*) and 17(*b*), in the case where the transfer belt 11 and the photosensitive drum 1*a* contact each other, when only a transfer bias for yellow is applied to the transfer roller 12*a*, a transfer current flows in the order of a resistance R4*a* of the transfer roller 12*a*, a contact resistance R5*a* between the transfer roller 12*a* and the transfer belt 11, a resistance R6*a* of the transfer belt 11 with respect to its thickness direction, a contact resistance R7*a* between the transfer belt 11 and the photosensitive drum 1*a*, a resistance R8*a* of the photosensitive drum 1*a* with respect to its radial direction, the drum shaft, and the transfer current detector 115*a*. A value of the transfer current varies depending on an applied voltage, an environment, or the like but is ordinarily several tens of μA to several hundreds of μA.

Here, resistances R9, R10 and R11 are those of the transfer belt 11 with respect to its lengthwise (longitudinal) direction and satisfy the following relationship (2):

$$R9,R10,R11 >> (R6a+R7a+R8a) \quad (2).$$

For this reason, most of the transfer current I113*a* does not flow in the lengthwise direction of the transfer belt 11 but flows in a direction toward the photosensitive drum 1*a*.

Figure 18:
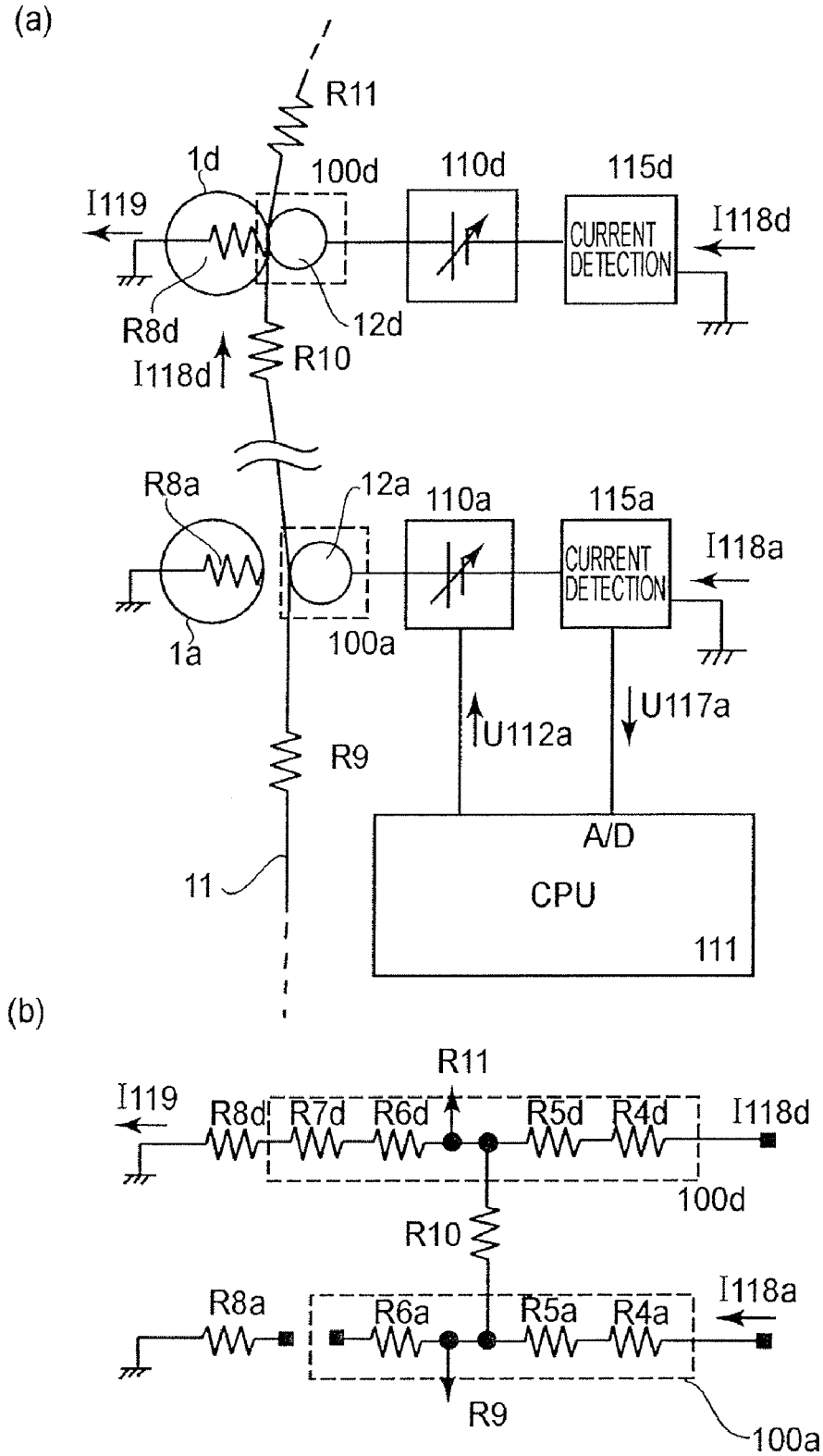
FIGS. 18(*a*) and 18(*b*) are schematic diagrams for illustrating yellow and black toner portions during separation between the transfer belt and the photosensitive drums.

On the other hand, as shown in FIGS. 18(*a*) and 18(*b*), in the case where the transfer belt 11 is separated from the photosensitive drum 1*a*, a transfer current I118*a* flows from the transfer roller 12*a* to the transfer belt 11 when only the transfer bias for yellow is applied to the transfer roller 12*a*. In this case, an electric resistance between the transfer belt 11 and the photosensitive drum is excessively large, so that the transfer current I118*a* flows toward the photosensitive drum 1*d* contacting the transfer belt 11. Accordingly, the transfer current I118*a* flows in the order of the lengthwise resistance R10 of the transfer belt 11, a resistance R6*d* of the transfer belt 11 with respect to its thickness direction, a contact resistance R7*d* between the transfer belt 11 and the photosensitive drum 1*d*, a resistance R8*d* of the photosensitive drum 1*d* with respect to its radial direction, the drum shaft, the ground, and the transfer current detector 115*a*. However, the lengthwise resistance R10 of the transfer belt 11 is large, so that a value of the transfer current which actually flows is very small.

Here, comparison between the values of the flowing transfer currents in the cases where the transfer belt 11 contacts the photosensitive drums 1 and is separated from the photosensitive drum 1*a* will be made. A load of the transfer bias circuit 110*a* during the separation of the transfer belt 11 is larger than that during the contact of the transfer belt 11 by a value substantially corresponding to the other lengthwise resistance R10 of the transfer belt 11.

Further, from the relationship (2) described above, the lengthwise resistance R10 of the transfer belt 11 is large, so that the transfer current I113*a* during the contact of the transfer belt 11 and the transfer current 118*a* during the separation of the transfer belt 11 satisfy the following relationship (3):

$$I113a >> I118a \quad (3).$$

(I118*a*=0 V)

[Detecting Method of Contact and Separation of Transfer (Conveying) Belt]

From the above results, when a threshold current Ia is preset to a value between those of the transfer currents I113*a* and I118*a* (I113*a*>Ia>I118*a*), it is possible to detect the contact and separation between the photosensitive drum(s) and the transfer belt 11. However, the process cartridge 7 is not completely disposed at the predetermined position of the apparatus main assembly in some cases where a user closes the door of the image forming apparatus after jam clearance or replacement of the process cartridge 7 is performed. In these cases, the position of the photosensitive drum 1 is shifted toward the transfer roller 12 side even when the transfer roller 12 is located at a position apart from the predetermined position of the process cartridge 7, so that a situation in which a sufficient space cannot be ensured between the transfer belt 11 and the photosensitive drum 1 is caused. In this situation, the transfer current is liable to flow between the transfer belt 11 and the photosensitive drum 1. As a result, there is a possibility that the state of the transfer belt 11 is erroneously detected as a "contact" state although the state of the transfer belt 11 should be judged as a "separation" state from the position of the transfer roller 12. For this reason, in this embodiment, the erroneous detection is prevented by utilizing the above-described moving mechanism. When the contact/separation operation is carried out, the transfer roller 12 is moved. As a result, when the transfer roller 12 is moved toward the photosensitive drum 1, the transfer roller 12 pushes the process cartridge 7 including the photosensitive drum 1 into the apparatus main assembly. This is because the transfer pressure is large as described above. The contact/separation operation is performed before the above-described detection of the current value (or a difference in voltage) by the discrimination means is started. More specifically, the detection of the current value (or a difference in voltage) by the discrimination means is started after the contact/separation operation is performed two times by the moving mechanism with respect to the transfer belt 11 and all the four photosensitive drums 1*a* to 1*d*. In this manner, by moving the process cartridges to proper positions in the apparatus main assembly before the detection.

Figure 19:
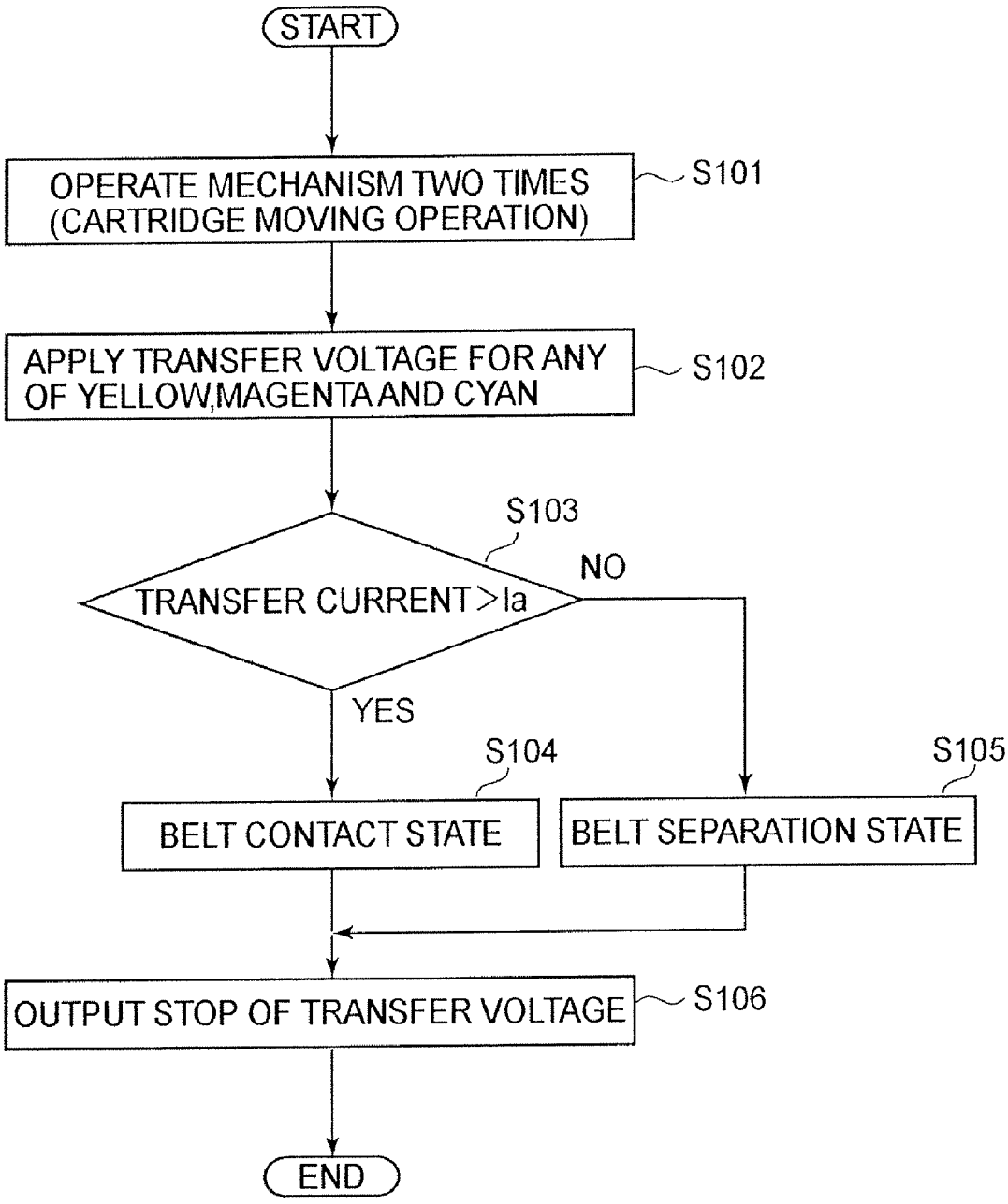
FIG. 19 is a flow chart showing detection of contact and separation of the transfer belt.

The above-described operation will be described more specifically with reference to FIG. 19 showing a flow chart of the operation.

First, as shown in FIG. 19, in step S101, the moving mechanism is operated two times before the detection of the contact and the separation is started to perform the moving operation for moving the process cartridges to the predetermined positions. After this moving operation (sequence) of the process cartridges, a transfer voltage is applied to an image forming portion (step S102) to detect a resultant current value. In this step, as the image forming portion to be supplied with the transfer voltage, it is possible to employ, e.g., an yellow image forming portion, a magenta image forming portion, or a cyan image forming portion. Then, in step S103, the detected current value is compared with the above-described threshold current Ia, so that the state between the transfer roller and the photosensitive drum is discriminated as to whether the state is the contact state or the separation state. In this case, a voltage value Va of the voltage signal U117*a* corresponding to the threshold current Ia is determined in advance. The state is judged as the contact state when a voltage value of the voltage signal U117*a* is larger than the voltage value Va and judged as the separation state when the voltage value is not larger than the voltage value Va (step S104 and step S105). After the detection of the contact or separation state, the output of the transfer voltage is terminated (step S106).

Incidentally, the reason why the moving mechanism is operated two times is that an operation from the monochromatic (printing) mode to the full-color (printing) mode or an operation from the full-color mode to the monochromatic mode is always ensured since there is a possibility that the state between the transfer belt and the photosensitive drum is a transfer state between the contact state and the separation state, so that the contact state is ensured at least one time at all the image forming portions to move all the process cartridges 7 to the predetermined portions.

By employing the above-described constitution, it is possible to reliably detect the position of the transfer roller 12 without providing a dedicated discrimination means, such as a sensor for directly recognizing the position of the transfer roller 12, in the belt unit.

In a similar manner as in the case of the yellow image forming portion, it is also possible to detect the contact state and the separation state of the transfer belt 11 at the magenta and yellow image forming portions by applying the transfer bias for magenta or yellow and detecting a resultant transfer current.

In this embodiment, the full-color printing mode using all the color toners is used as the first mode and the monochromatic printing mode using only the black toner is used as the second mode but the present invention is not limited thereto. For example, it is also possible to employ various combinations using, as the second mode, a two-color mode using the yellow and magenta toners, a two-color mode using the magenta and cyan toners, a three-color mode using the yellow, magenta and cyan toners, and the like. Further, in this embodiment, the combination using the four color toners is employed but it is also possible to employ appropriate combinations depending on the number of colors. Even in image forming apparatuses employing the above-described combinations, by providing a current detecting means for each color, it is also possible to independently detect the contact state and the separation state with respect to each color.

Figure 20:
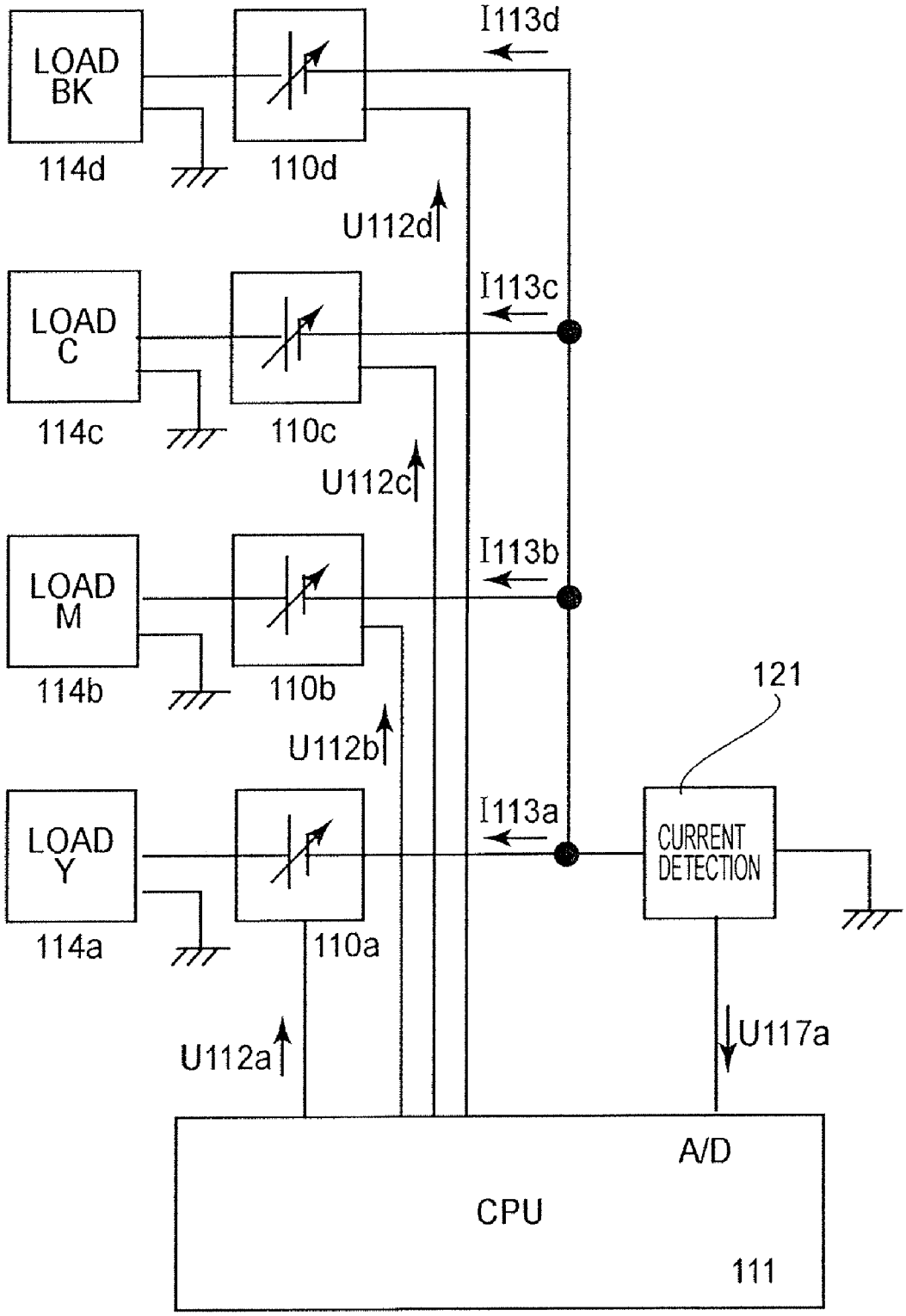
FIG. 20 is a diagram showing a transfer current detection circuit and wiring around transfer bias power sources.

Further, in the constitution shown in FIG. 15, the four transfer current detectors 115*a* to 115*d* are employed but the present invention is not limited thereto. As shown in FIG. 20, it is also possible to employ a constitution using a single transfer current detector 121 for reducing a production cost. Even in this constitution, by utilizing any of the transfer bias circuits for yellow, magenta and cyan, it is possible to detect the contact state and the separation state of the transfer belt for each color.

Second Embodiment

In this embodiment, the separation state of the transfer belt is judged in a system in which the transfer current is subjected to constitutions which are not specifically described, the same constitutions as in the first embodiment are employed. This is true for the third and fourth embodiments described later.

Even when constant-current control in which the transfer current passing through each of the loads 114 (114*a* to 114*d*) is kept constant is utilized in the constitution shown in FIG. 15, the same effect as in the first embodiment can be achieved. In the yellow image forming portion, the transfer current detector 115*a* converts the transfer current I113*a* into the voltage signal U117*a* proportional to a value of the transfer current and outputs the voltage signal U117*a* to the A/D port of the CPU 111. The CPU 111 controls the voltage signal U117*a* so as to be substantially equal to a predetermined voltage value V1. The voltage control signal U112*a* is a rectangular signal with a constant frequency and is capable of increasing an output voltage from the transfer bias circuit 110*a* with a longer signal-on time. When the voltage signal U117*a* is smaller than the predetermined voltage value V1, the transfer current is small, so that the CPU 111 sends the voltage control signal with a prolonged signal-on time so as to increase the output voltage from the transfer bias circuit 110*a*. When the voltage signal U117*a* is larger than the predetermined voltage value V1, the transfer current is large, so that the CPU 111 sends the voltage control signal with a shortened signal-on time so as to decrease the output signal from the transfer bias circuit 110*a*. By repeating the above-described control operations, it is possible to control the transfer current at a constant value. It is also possible to effect transfer current control at other image forming portions for magenta, cyan and black similarly as in the case of the yellow image forming portion.

In such a control system, when the transfer belt and the photosensitive drum are placed in the separation state, a little current flows between the transfer belt and the photosensitive drum, so that a value of the transfer current I113*a* is lower than that during a normal operation. In this case, the CPU 111 outputs the voltage control signal U112*a* with a prolonged signal-on time but at this time, a predetermined transfer current (predetermined voltage V1) cannot be carried even when a maximum transfer voltage is applied. Accordingly, in the case where the transfer current I113*a* does not reach the predetermined current value although the voltage control signal with a signal-on time corresponding to the maximum transfer voltage is outputted, it is possible to make judgement that the transfer belt 11 and the photosensitive drum 1 are separated from each other. Further, by employing the constitution shown in FIG. 21, it is possible to judge the contact and separation states of the transfer belt 11 by detecting both of the transfer current and the transfer voltage. Compared with the constitution shown in FIG. 15, in the constitution shown in FIG. 21, voltage signals U120*a* to U120*d* proportional to output voltages from the respective transfer bias circuits 110*a* to 110*d* are added. The constitution in this embodiment for detecting both of the transfer current and the transfer voltage includes 8 A/D ports of the CPU 111.

Figure 21:
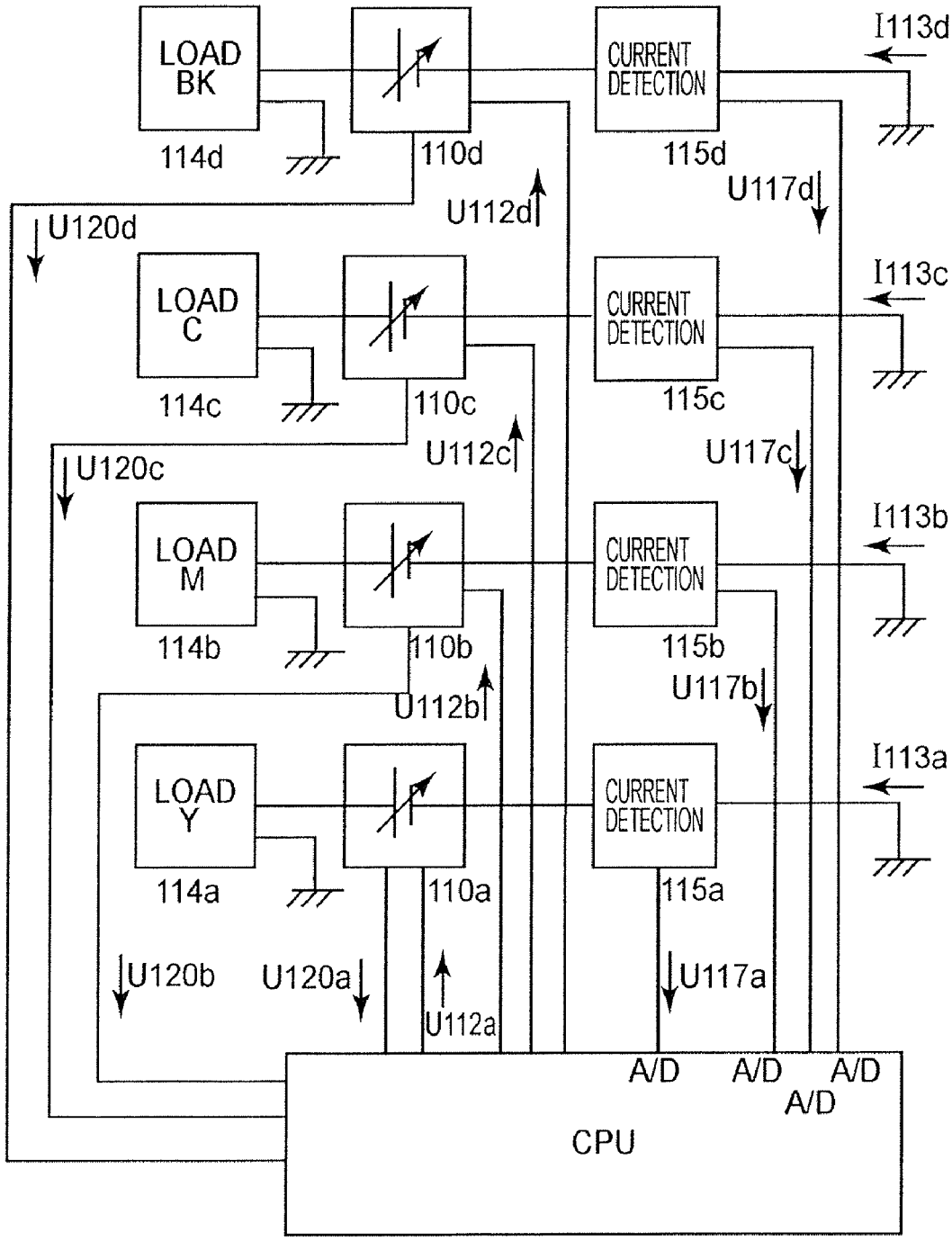
FIG. 21 is a diagram showing a detection circuit of a transfer current and a transfer voltage.

In the constitution shown in FIG. 21, for example, at the yellow image forming portion, the transfer current detector 115*a* converts the transfer current I113*a* into the voltage signal U117*a* proportional to a value of the transfer current and outputs the voltage signal U117*a* to the A/D port of the CPU 111. The CPU 111 controls the voltage signal U117*a* so as to be substantially equal to a predetermined voltage value V1. The voltage control signal U112*a* is a rectangular signal with a constant frequency and is capable of increasing an output voltage from the transfer bias circuit 110*a* with a longer signal-on time. When the voltage signal U117*a* is smaller than the predetermined voltage value V1, the transfer current is small, so that the CPU 111 sends the voltage control signal with a prolonged signal-on time so as to increase the output voltage from the transfer bias circuit 110*a*. When the voltage signal U117*a* is larger than the predetermined voltage value V1, the transfer current is large, so that the CPU 111 sends the voltage control signal with a shortened signal-on time so as to decrease the output signal from the transfer bias circuit 110*a*. By repeating the above-described control operations, it is possible to control the transfer current at a constant value. It is also possible to effect transfer current control at other image forming portions for magenta, cyan and black similarly as in the case of the yellow image forming portion.

In such a control system, when the transfer belt and the photosensitive drum are placed in the separation state, a little current flows between the transfer belt and the photosensitive drum, so that a value of the transfer current I113*a* is lower than that during a normal operation. In this case, a predetermined transfer current (predetermined voltage V1) cannot be carried even when a maximum transfer voltage is applied. For this reason, the CPU 111 outputs the voltage control signal U112*a* with a prolonged signal-on time. At this time, by setting a maximum voltage value V3 capable of being outputted from the transfer bias circuit so as o be larger than a maximum voltage value V2 during an ordinary operation, it is possible to judge the contact and separation states between the transfer belt 11 and the photosensitive drum 1. More specifically, when an output value of the transfer bias circuit 110*a* detected by the transfer bias voltage detection signal U120*a* is not less than the voltage V2, judgement that the transfer belt 11 and the photosensitive drum 1 are separated from each other.

As described above, by detecting not only the value of current generated when a voltage is applied to the transfer roller 12 but also the voltage value when the current is applied to the transfer roller 12, it is possible to discriminate the contact and separation state of the transfer belt.

Third Embodiment

In the above-described embodiments, the image forming apparatus including the transfer belt (belt member) as a recording material carrying member for carrying the recording material is used. However, the present invention is not limited to the image forming apparatus using the transfer belt. In this embodiment, an image forming apparatus including an intermediary transfer belt (belt member) as an intermediary transfer member for temporarily carrying a toner image is used. In this image forming apparatus, in the first mode, toner images formed on a plurality of photosensitive drums are successively transferred onto the intermediary transfer belt in a superposition manner and are then collectively transferred onto the recording material from the intermediary transfer belt. It is also possible to apply the above-described constitutions in the first and second embodiments to the image forming apparatus of this embodiment.

Fourth Embodiment

In the above-described embodiments, the full-color mode (first mode) for multi-color recording and the monochromatic mode (second mode) for monochromatic recording are employed. However, in the case where the image forming apparatus is left standing for a long term in a state in which the belt member and the image bearing member contact each other, local plastic deformation such as creep is caused with respect to the belt member or the transfer member and there is a possibility of a lowering in image quality after the standing.

In order to obviate these problems, a mode in which transfer members are separated from image bearing members to separate belt members with respect to all the colors, i.e., all-color separation mode (third mode) is effective.

In this embodiment, a constitution in which the third mode is added to the constitution of the first embodiment. The third mode will be specifically described.

Figure 22:
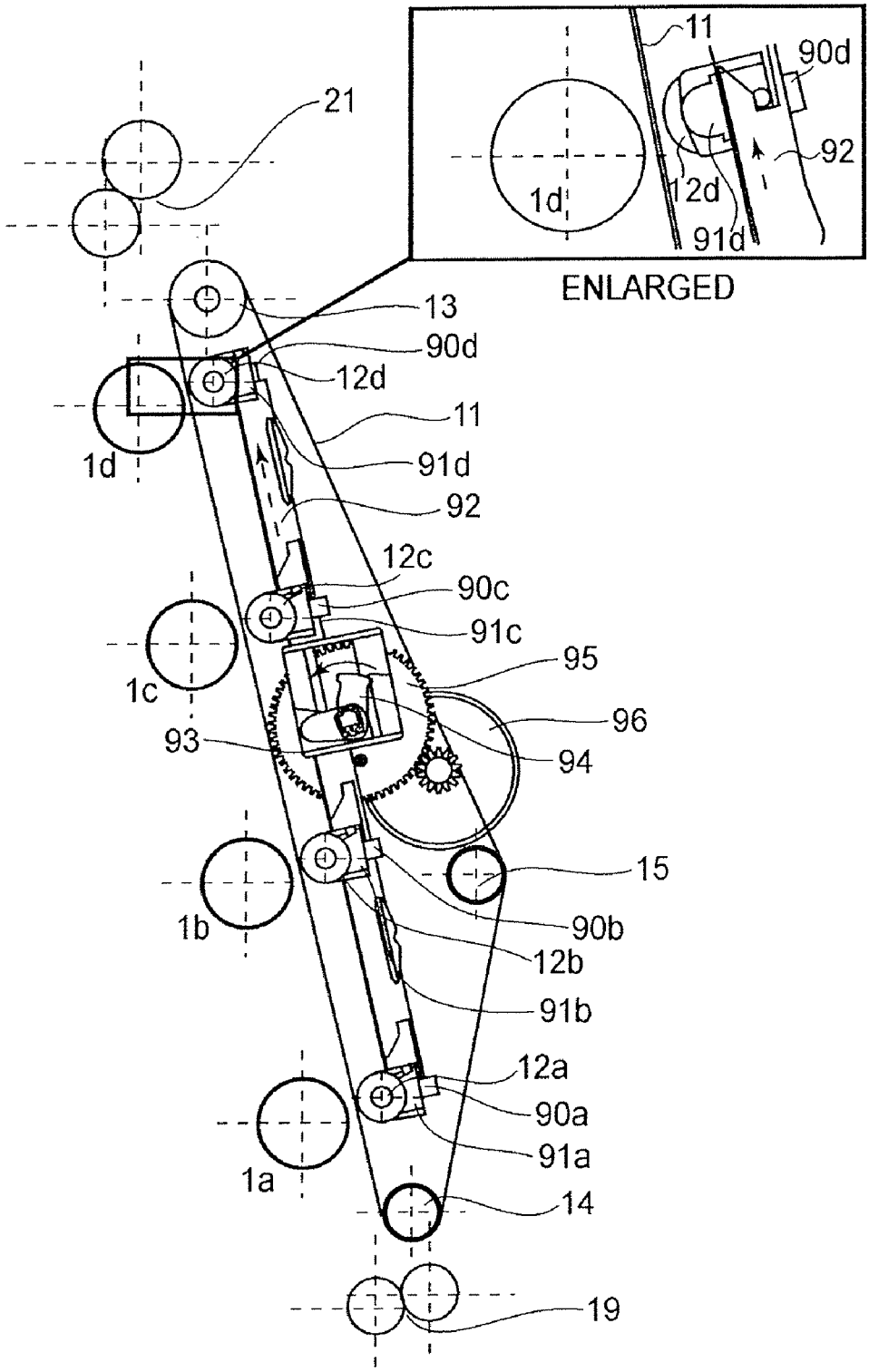
FIG. 22 is a schematic view showing a separation relationship between a transfer belt and photosensitive drums of an image forming apparatus according to a fourth embodiment.
Figure 23:
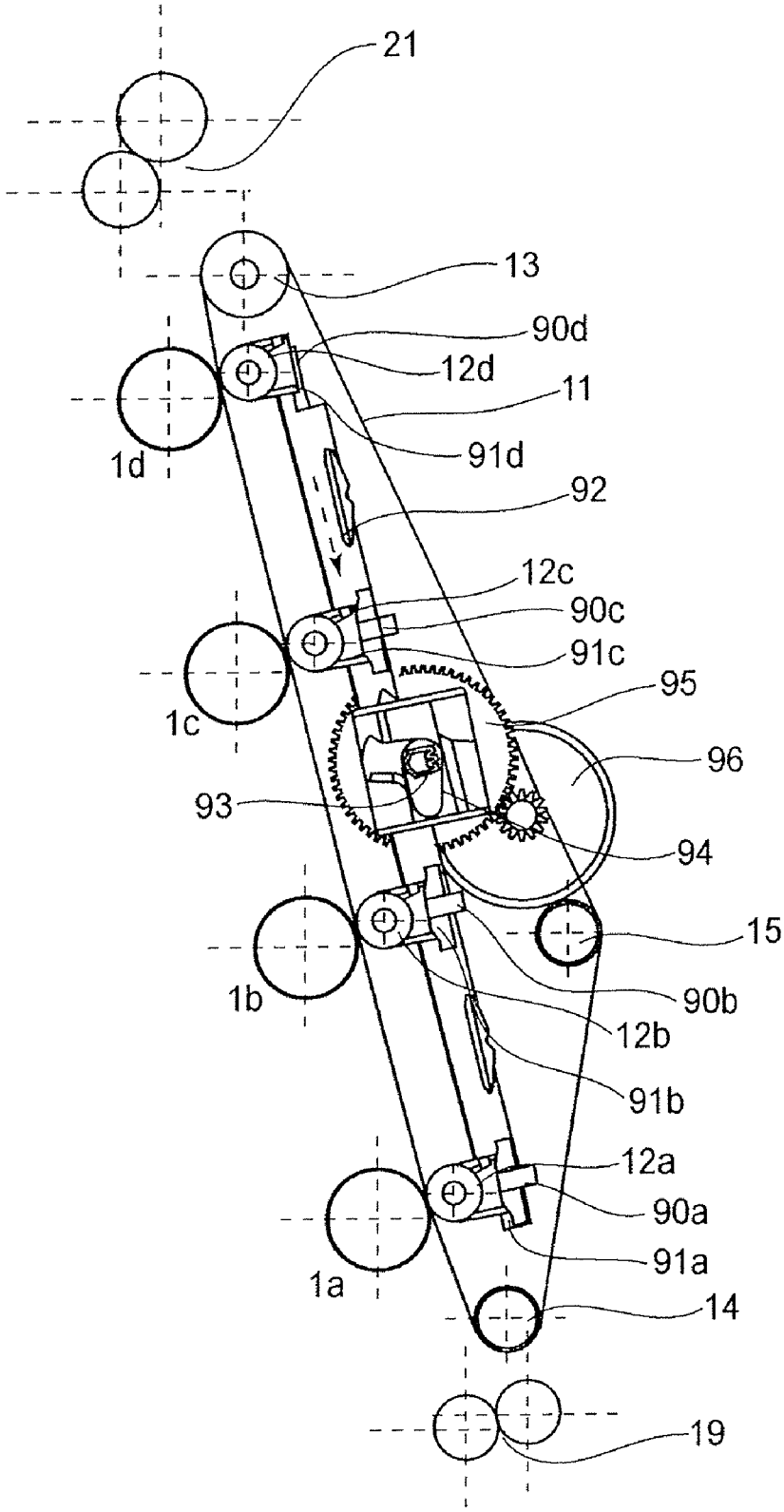
FIG. 23 is a schematic view showing a positional relationship between the transfer belt and the photosensitive drums of the image forming apparatus of the fourth embodiment.

FIG. 22 is a sectional view showing a principal portion for illustrating the all-color separation mode (third mode), and FIG. 23 is a sectional view showing a principal portion for illustrating the first mode (all-color contact mode).

As described above, the separating gear 95 realizes ¼ rotation control by turning on and off the solenoid. More specifically, for each 90 degree-rotation of the separating gear 95 in the counterclockwise direction, the operation is changed in the order of those shown in FIG. 11, FIG. 22, FIG. 23, and FIG. 12. In other words, for each 90 degree-rotation of the separating gear 95, the operation mode is changed in the order of the full-color mode (first mode), the all-color separation mode (third mode), the full-color mode (first mode), and the monochromatic mode (second mode). After the monochromatic mode (second mode), the separating gear 95 is further rotated 90 degrees, the operation mode is returned to the full-color mode (first mode). In this manner, by employing the full-color mode at two positions, it is possible to reduce a time required for switching the operation mode to the full-color mode. As a result, it is possible to realize a reduction in first printout time.

Figure 24:
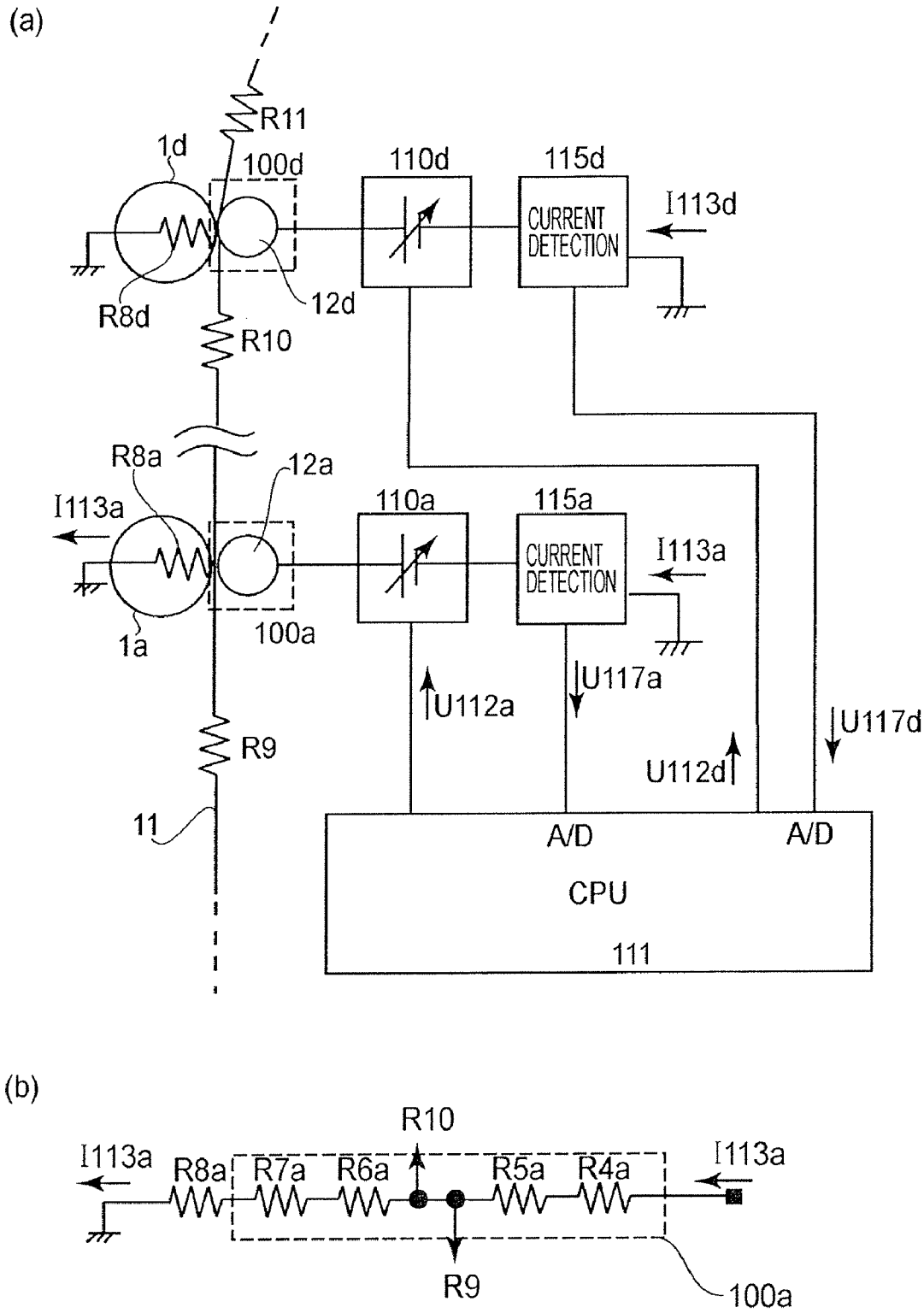
FIGS. 24(*a*), 24(B), 25(*a*) and 25(*b*) are schematic wiring view showing wiring around transfer bias power sources in the image forming apparatus of Fourth Embodiment.
Figure 25:
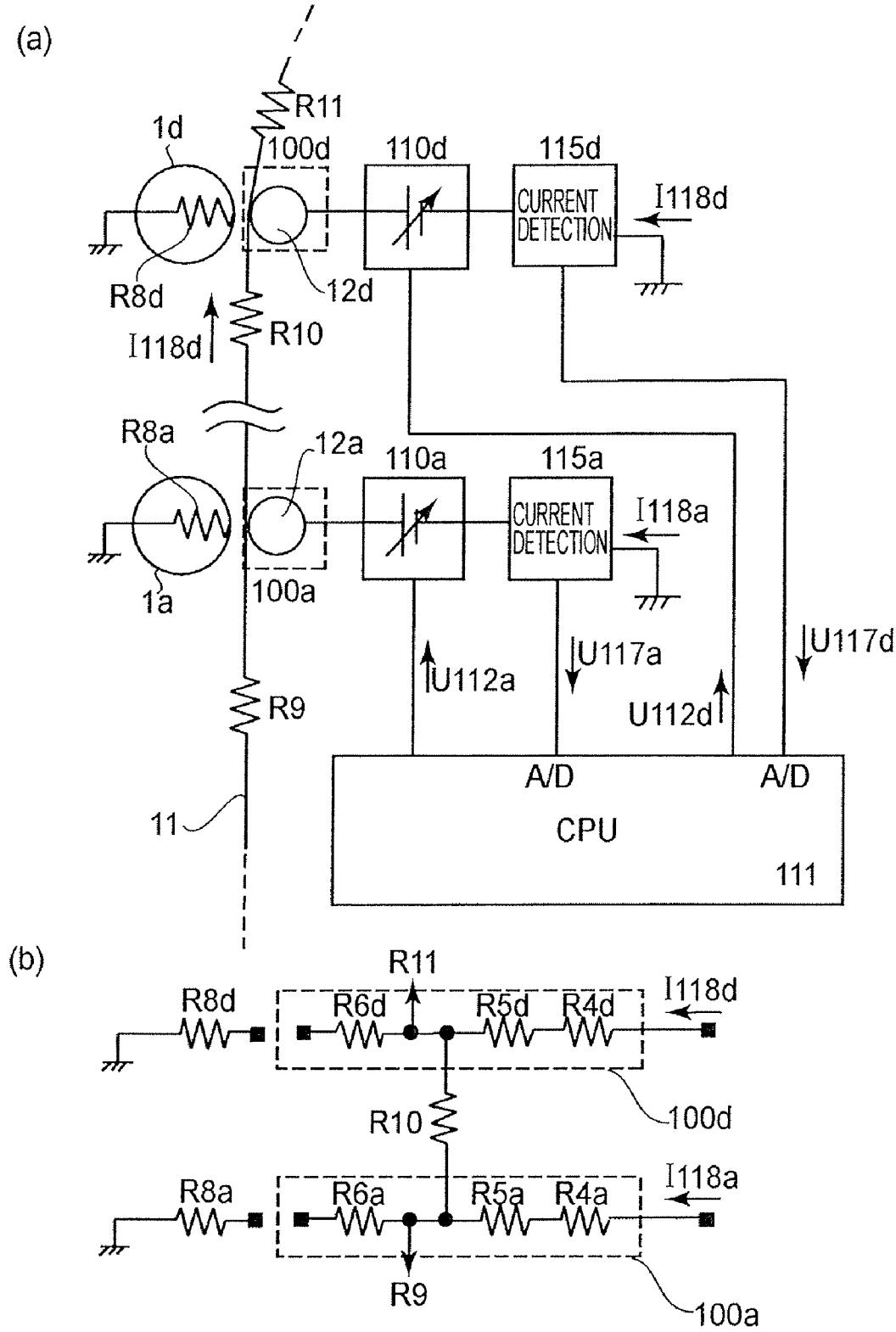

The transfer current when the all-color separation mode will be described with reference to FIGS. 24(*a*) and 24(*b*) and FIGS. 25(*a*) and 25(*b*), wherein FIGS. 24(*b*) and 25(*b*) are detailed views of the transfer member and its neighborhood. FIG. 24(*a*) is a schematic view for illustrating yellow and black transfer portions during contact of the transfer belt with the photosensitive drums. Compared with the constitution shown in FIG. 17(*a*), in the constitution shown in FIG. 24(*a*), the black station (transfer portion) is communicatable with the CPU 111 via a signal 112*d* and a voltage signal U117*d* proportional to a value of the transfer current similarly as in the yellow station (transfer portion). FIG. 25(*a*) is a schematic view for illustrating yellow and black transfer portions during separation of the transfer belt from the photosensitive drum similarly as in FIG. 18(*a*). Different from FIG. 18(*a*), in FIG. 25(*a*), in the monochromatic mode, the photosensitive drum 1 and the transfer belt 11 are separated from each other not only at the yellow transfer portion but also at the black transfer portion. As a result, the current does not pass between the transfer belt and the photosensitive drums. By employing such a constitution, it is possible to detect the all-color separation mode (third mode) by using the same discrimination means as in the first embodiment. That is, it is possible to detect the separation between the transfer belt 11 and all the photosensitive drums 1.

Figure 26:
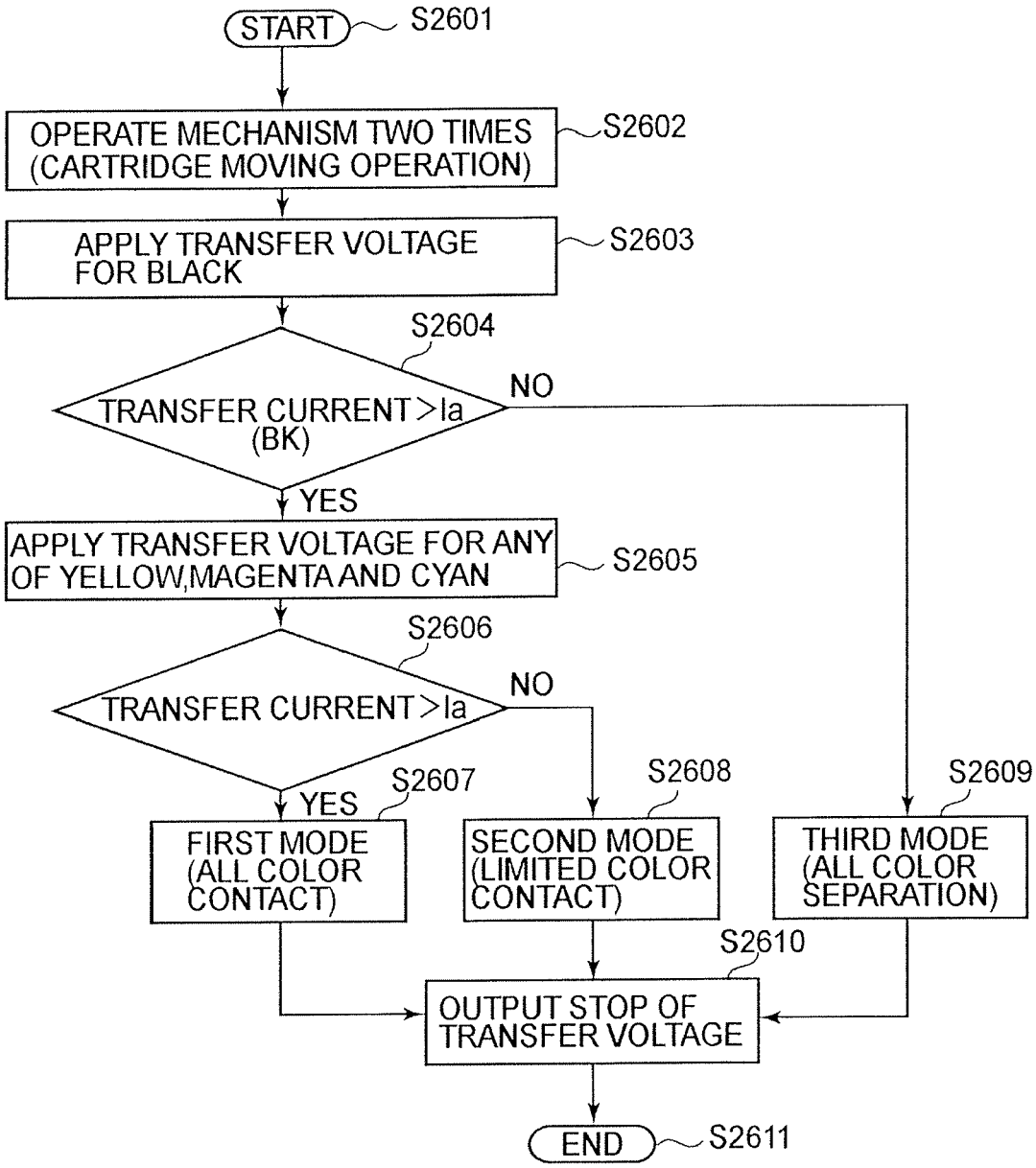
FIG. 26 is a flow chart showing detection of contact and separation of the transfer belt in the image forming apparatus of a fourth embodiment.

A flow chart of this detection operation is shown in FIG. 26.

After detection start (step S2601), the moving mechanism of the transfer member is operated immediately (cartridge moving operation) (step S2602). A transfer voltage for black is applied (step S2603) and comparison with the above-described threshold current Ia is made, so that discrimination as to whether the state between the black transfer roller and the black photosensitive drum is the contact state or the separation state is made (step S2604). In the case where the transfer current for black is larger than the threshold current Ia, a transfer voltage for any of yellow, magenta and cyan is applied and then similarly as in the case of black, comparison with the threshold current Ia is made (steps S2605 and S2606). As a result, the following three judgements (1), (2) and (3) are made.

(1) When both of the transfer current for black and the transfer current for any of yellow, magenta and cyan are larger than Ia, the operation mode is judged as the first mode (all-color contact mode) (step S2607).

(2) When the transfer current for black is larger than Ia but the transfer current for any of yellow, magenta and cyan is not, the operation mode is judged as the second mode (separation mode for only limited color) (step S2608).

(3) When both of the transfer current for black and the transfer current for any of yellow, magenta and cyan are not larger than Ia, the operation mode is judged as the third mode (all-color separation mode) (step S2609).

After the mode detection, the output of the transfer voltage is stopped to complete the detecting operation (steps S2610 and S2611).

Further, even when the full-color image (first mode) is employed at two positions as described above, it is possible to judge as to whether the transfer portion is located at which position of the two positions by recognizing the contact and separation states between the photosensitive drum 1 and the transfer belt 1 with transfer currents before and after an associated full-color mode (first mode) as indicators at each of the yellow and black image forming portions.

Incidentally, in the above-described embodiments, the image forming apparatus using the transfer roller as the transfer member is used but the present invention is not limited to the roller-like member. It is also possible to achieve the same effect as in the case of using the roller-like member by applying the constitution of the present invention to a pad-like member such as a transfer pad or a blade-like member such as a transfer blade.

Further, in the above-described embodiments, the image forming apparatus including the four image forming portions different in color. However, the number of the image forming portions and the kind of colors are not limited thereto and may be appropriately set as desired. The present invention is also applicable to an image forming apparatus using such a transfer roller that the toner image is directly transferred from the photosensitive drum to the recording material S without using the belt. In the case where either one of the positions of the photosensitive drum and the transfer roller is deviated from a predetermined position, when the position of the transfer roller is detected after the contact/separation operation is once performed, it is possible to further accurately recognize the position of the transfer roller.

In the above-described embodiments, the printer is used as the image forming apparatus but the present invention is not limited thereto. For example, it is also possible to use other image forming apparatus such as a copying machine, a facsimile apparatus, a multi-function machine having plural functions of the copying machine, the facsimile apparatus, and the like apparatus. It is also possible to achieve the effect of the present invention by applying the constitutions of the present invention to these image forming apparatuses.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 226495/2006 filed Aug. 23, 2006, which is hereby incorporated by reference.

What is claimed is:

1. An image forming apparatus comprising:

a plurality of units, each unit comprising an image bearing member for bearing a toner image, each unit being detachably mountable to a main assembly of the image forming apparatus;

a belt for transferring the toner image from the image bearing member of each unit onto a transfer material;

a plurality of transfer members, each transfer member corresponding to one of said plurality of units and being provided at a position in which the transfer member opposes a corresponding image bearing member of a corresponding unit through said belt, for transferring the toner image from the corresponding image bearing member;

a moving mechanism for moving said plurality of transfer members between a first position and a second position in which each transfer member of said plurality of transfer members is moved farther from the corresponding image bearing member than the first position;

current detecting means for detecting a current passing through each transfer member of said plurality of transfer members; and a recognizing portion for detecting a position of each transfer member of said plurality of transfer members, to which a voltage has been applied, on the basis of a detection result of said current detecting means, wherein a force, with which each transfer member of said plurality of transfer members presses said belt against the corresponding image bearing member when the transfer member is moved from the second position to the first position by said moving mechanism, is capable of pressing a corresponding unit of said plurality of units into a predetermined position in the main assembly of said image forming apparatus, and wherein said moving mechanism always performs, before said recognizing portion detects the position of each transfer member of said plurality of transfer members, an operation for moving each transfer member of said plurality of transfer members from the second position to the first position at least one time.

2. An apparatus according claim 1, wherein said image forming apparatus is operable in a first mode in which a multi-color image is formed in a state in which all of said plurality of transfer members are located at the first position and is operable in a second mode in which a monochromatic image is formed in a state in which one of said plurality of transfer members is located at the first position and other of said plurality of transfer members are located at the second position.

3. An apparatus according claim 1, wherein said belt is rotatable relative to the main assembly of said image forming apparatus, and wherein each unit of said plurality of units is detachably mountable to the main assembly of said image forming apparatus when said belt is moved relative to the main assembly to expose the main assembly.

4. An apparatus according claim 1, wherein said belt is a transfer material carrying belt for carrying the transfer material.

5. An apparatus according claim 1, wherein said belt is an intermediary transfer belt for receiving the toner image from said image bearing member of each of said plurality of units.

6. An apparatus according claim 1, wherein said recognizing portion detects the position of each transfer member of said plurality of transfer members as the first position when said current detecting means detects the current which is not less than a threshold current.

* * * * *